US011070010B2

(12) United States Patent
I

(10) Patent No.: US 11,070,010 B2
(45) Date of Patent: Jul. 20, 2021

(54) OVERHEATING DESTRUCTIVE DISCONNECTING METHOD FOR SWITCH

(71) Applicant: GREEN IDEA TECH INC., Mahe (SC)

(72) Inventor: Hsiang-Yun I, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 282 days.

(21) Appl. No.: 16/224,787

(22) Filed: Dec. 18, 2018

(65) Prior Publication Data

US 2020/0014153 A1 Jan. 9, 2020

(30) Foreign Application Priority Data

Jul. 3, 2018 (TW) ..... 10712301

(51) Int. Cl.
*H01R 13/696* (2011.01)
*H01R 13/713* (2006.01)
(Continued)

(52) U.S. Cl.
CPC ..... *H01R 13/696* (2013.01); *H01H 37/32* (2013.01); *H01R 13/10* (2013.01); *H01R 13/713* (2013.01); *H01H 2037/326* (2013.01)

(58) Field of Classification Search
CPC ..... H01H 23/02; H01H 23/12; H01H 23/16; H01H 23/24; H01H 37/32; H01H 37/323;
(Continued)

(56) References Cited

U.S. PATENT DOCUMENTS 5,262,748 A * 11/1993 Tsung-Mou ..... H01H 73/26 337/66
6,552,644 B2 * 4/2003 Yu ..... H01H 73/30 200/277.1
(Continued)

FOREIGN PATENT DOCUMENTS

CN 103441019 B 10/2015
TW 321352 11/1997
(Continued)

*Primary Examiner* — Matthew V Nguyen
(74) *Attorney, Agent, or Firm* — Michael D. Eisenberg

(57) ABSTRACT

An overheating destructive disconnecting method for switch, whereby an operating member applies a first elastic force under normal conditions to enable the movable conductive member contacts a first conductive member and a second conductive member to form a conductive circuit; and a second elastic force to enable the movable conductive member to separate from the first conductive member or the second conductive member. The installation position of the overheating destructive member is used to receive heat energy instead of allowing current to flow thereto. When the overheating destructive member is destructed or deformed under a fail temperature condition, lessening or loss of the force applied by the first elastic force towards the movable conductive member causes the movable conductive member to no longer allow electrical conduction to the first conductive member and the second conductive member, thereby breaking the current-carrying circuit.

5 Claims, 35 Drawing Sheets

(51) Int. Cl.
*H01H 37/32* (2006.01)
*H01R 13/10* (2006.01)

(58) Field of Classification Search
CPC ..... H01H 37/64; H01H 37/72; H01H 37/74; H01H 2037/326; H01R 13/10; H01R 13/02; H01R 13/696; H01R 13/71; H01R 13/713; H01R 13/7137
See application file for complete search history.

(56) References Cited

U.S. PATENT DOCUMENTS

| | | | | |
|---|---|---|---|---|
| 9,698,542 | B1 | 7/2017 | I | |
| 2020/0013564 | A1* | 1/2020 | I | H01H 1/021 |
| 2020/0105486 | A1* | 4/2020 | I | H01H 37/32 |

FOREIGN PATENT DOCUMENTS

| | | |
|---|---|---|
| TW | 560690 | 11/2003 |
| TW | 250403 | 11/2004 |
| TW | 382568 | 6/2010 |

* cited by examiner

OVERHEATING DESTRUCTIVE DISCONNECTING METHOD FOR SWITCH

CROSS REFERENCES TO RELATED APPLICATIONS

The present application claims priority from Taiwanese Patent Application Serial Number 107123012, filed Jul. 3, 2018, the disclosure of which is hereby incorporated by reference herein in its entirety.

BACKGROUND OF THE INVENTION

(a) Field of the Invention

The present invention relates to an overheating destructive disconnecting method for switch, and more particularly to a disconnecting method that is distinct from a fuse and different from a bimetallic strip. An overheating destructive member of the present invention does not depend on the passing of current to enforce destruction thereof, but uses heat energy transfer to enforce destruction and cause the switch to cut off power.

(b) Description of the Prior Art

Seesaw switches of the prior art use a control switch to effect back and forth pivot rotation within a specified angle range to control closing or opening a circuit. For example, the prior art structure of a "Spark shielding structure of switch" disclosed in ROC Patent No. 560690 describes a positioning feature when pivot rotating a switch to position the switch at a first position or a second position to form a closed circuit or an open circuit.

As for press switches of the prior art, pressing the press switch enables cycling through controlling the closing or opening of a circuit, wherein the press button uses the reciprocating press-button structure similar to that used in an automatic ball-point pen of the prior art, whereby the press button is positioned at a lower position or an upper position each time the switch press button is pressed, an example of which is described in the prior art structure of a "Push-button switch" disclosed in China Patent No. CN103441019.

In the prior art structure of an "Improved structure of an on-line switch" described in ROC Patent No. 321352, a switch structure is disclosed that is provided with a fuse; however, the fuse is positioned in the path of the power supply live wire, and thus necessarily depends on electric current passing therethrough in order to bring about a protective effect. In particular, only when the power supply is overloaded will the fuse melt and cut off the supply of power. In as much the fuse requires a current to pass through during operation; however, the current must be excessive in order to melt the fuse, hence, a low-melting-point lead-tin allow or zinc, that have an electric conductivity far lower than that of copper, is often used for the fuse. Taking an extension cord socket as an example, which mainly uses copper as a conductive body, if the extension cord socket is combined with the switch disclosed in the above-described ROC Patent No. 321352 to control the power supply, then conductivity of the fuse is poor, easily resulting in power-wasting problems.

In the prior art structure of a "Bipolar type auto power off safety switch" described in ROC Patent No. M382568, a bimetallic strip type overload protection switch is disclosed; however, the bimetallic strip must similarly be positioned in the path of the electric current, and thus necessarily depends on electric current passing therethrough for deformation of the bimetallic strip to occur. More particularly, an overloaded electric current is necessary in order to cause the bimetallic strip to deform and break the circuit.

In the prior art structure of an "Overload protection switch structure for group type socket" described in ROC Patent No. M250403, an overload protection switch applied in an extension cord socket is disclosed, wherein the patented overload protection switch is fitted with a bimetallic strip. When the total power of the entire extension cord socket exceeds the rated power, the bimetallic strip undergoes heat deformation and automatically trips, thereby achieving a power-off protective effect. However, the bimetallic strip necessarily depends on electric current passing therethrough in order to bring about an overload protective effect. Moreover, electric conductivity of the bimetallic strip is far lower than that of copper, which, thus, easily results in power-wasting problems.

Nevertheless, apart from current overload causing overheating, taking an extension cord socket as an example, the following situations are all possible scenarios resulting in overheating of any one of the sockets, including:

1. Serious oxidation of the metal pins of the plug, wherein the metal pins have become coated with oxides; thus, when the plug is inserted into a socket, the oxides, having poor conductivity, cause greater electrical resistance, which results in the socket overheating.
2. When inserting the metal pins of a plug into a socket, and the metal pins are not completely inserted, resulting in only partial contact, then the contact areas are too small, which causes the socket to overheat.
3. Metal pins of the plug are deformed or worn out, resulting in incomplete contact when inserted into a socket and the contact areas being too small, which gives rise to the socket overheating.
4. Metal pins of the plug or metal strips of the socket are stained with foreign substances, such as dust or dirt, causing poor electric conductivity, which results in greater electrical resistance and overheating.

The above-described conditions result in a critical drop in the operating temperature in the locality of the socket and the operating temperature in the locality of the overload protection switch.

The inventor of the present invention in "Assembly and method of plural conductive slots sharing an overheating destructive fixing element" described in U.S. Pat. No. 9,698,542 disclosed distance of a copper strip and temperature difference experimentation, and from the test results presented in TABLE 2 of the above patent, it can be seen that if the above-described overheated socket is positioned at test position 10 of TABLE 2, and the above-described overload protection switch is positioned at test position 1 of TABLE 2, with a distance of 9 cm between the two positions, at the time the socket operating temperature reaches 202.9° C., after 25 minutes, the operating temperature of the overload protection switch is only 110.7° C.; that is, when the distance between the socket and the overload protection switch is 9 cm, and when the operating temperature of the socket has already overheated to a temperature of 202.9° C. with the possibility of accidental combustion, then the bimetallic strip of the overload protection switch is still only at a temperature of 110.7° C., and has not yet reached deformation temperature; thus, the overload protection switch will not automatically trip a power-off.

Because there are many circumstances resulting in socket overheating, and the distance between the socket and the bimetallic strip of the overload protection switch can result in an enormous temperature difference, in order to effectively achieve overheating protection, an overload protection switch bimetallic strip should be installed on each of the plug sockets of the extension cord socket. However, the price of a bimetallic strip type overload protection switch is relatively high, thus installing a bimetallic strip on each of the sockets of an extension cord socket will lead to a substantial increase in cost and go against it being available to all.

SUMMARY OF THE INVENTION

Based on the above-described reasons, in order to overcome the shortcomings, the present invention provides an overheating destructive disconnecting method for switch, comprising the following steps:

Enabling a first elastic force through an operating member under normal conditions to concurrently apply a force to an overheating destructive member and a movable conductive member, whereby the force application direction of the first elastic force enables the movable conductive member to concurrently contact a first conductive member and a second conductive member to form a conductive circuit; enabling a second elastic force through the operating member to act on the movable conductive member, whereby the force application direction of the second elastic force enables the movable conductive member to separate from the first conductive member or the second conductive member; enabling installation position of the overheating destructive member to only receive heat energy from a current-carrying circuit and not be used to allow current to flow to the current-carrying circuit. Accordingly, when the overheating destructive member is destructed or deformed under a fail temperature condition, resulting in lessening or loss of the force applied by the first elastic force acting on the movable conductive member, then the second elastic force presses and forces the movable conductive member to change position, which causes the movable conductive member to no longer allow electrical conduction to the first conductive member and the second conductive member, thereby breaking the current-carrying circuit.

Further, the fail temperature of the overheating destructive member lies between 100° C. to 250° C. Furthermore, the overheating destructive member is made of plastic material, or is made of metal or an alloy, wherein the alloy is a tin-bismuth alloy, or additionally add one of or a combination of the metals cadmium, indium, silver, tin, lead, antimony, or copper to tin and bismuth.

The present invention further provides an overheating destructive disconnecting method for electric equipment, which uses the above-described overheating destructive disconnecting method for switch to control the power-on state and power-off state of the electric equipment. The first conductive member and the second conductive member are bridge connected to a live power line or a neutral power line in the path of the electric current of the electric equipment.

Based on the above-described technological characteristics, the present invention is able to achieve the following effects:

1. The overheating destructive member is not positioned in the path of the electric current, and is not responsible for transmitting current. Hence, when the present invention is used in an electric appliance or an extension cord socket, electric conductivity of the overheating destructive member is far lower than that of copper, and will not directly influence electric effectiveness of the electric appliance or the extension cord socket.

2. The entire structure is simple, easily manufactured, and will not markedly increase the size of the switch. Moreover, manufacturing cost is relatively low, and is easily embodied in known seesaw switches, press switches, or other switches.

3. Because of its small size and low cost, the heat destructive disconnecting switch is suitable for application in extension cord switches. For example, installing each of the plug sockets of the extension cord with a heat destructive disconnecting switch ensures the safety of each set of socket apertures corresponding to each of the switches when in use, and also redresses the high cost of conventional bimetallic strips, and the shortcoming whereby a plurality of sets of socket apertures are required to jointly use one overload protection switch, which will not protect socket apertures distanced further away from the overload protection switch that are already overheating, resulting in an increase in temperature thereof, but the overload protection switch has still not tripped because the temperature has not yet reached the trip temperature.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Based on the above-described technological characteristics, the major effects of an overheating destructive disconnecting method for switch or electric equipment of the present invention are clearly presented in the following embodiments.

Figure 1:
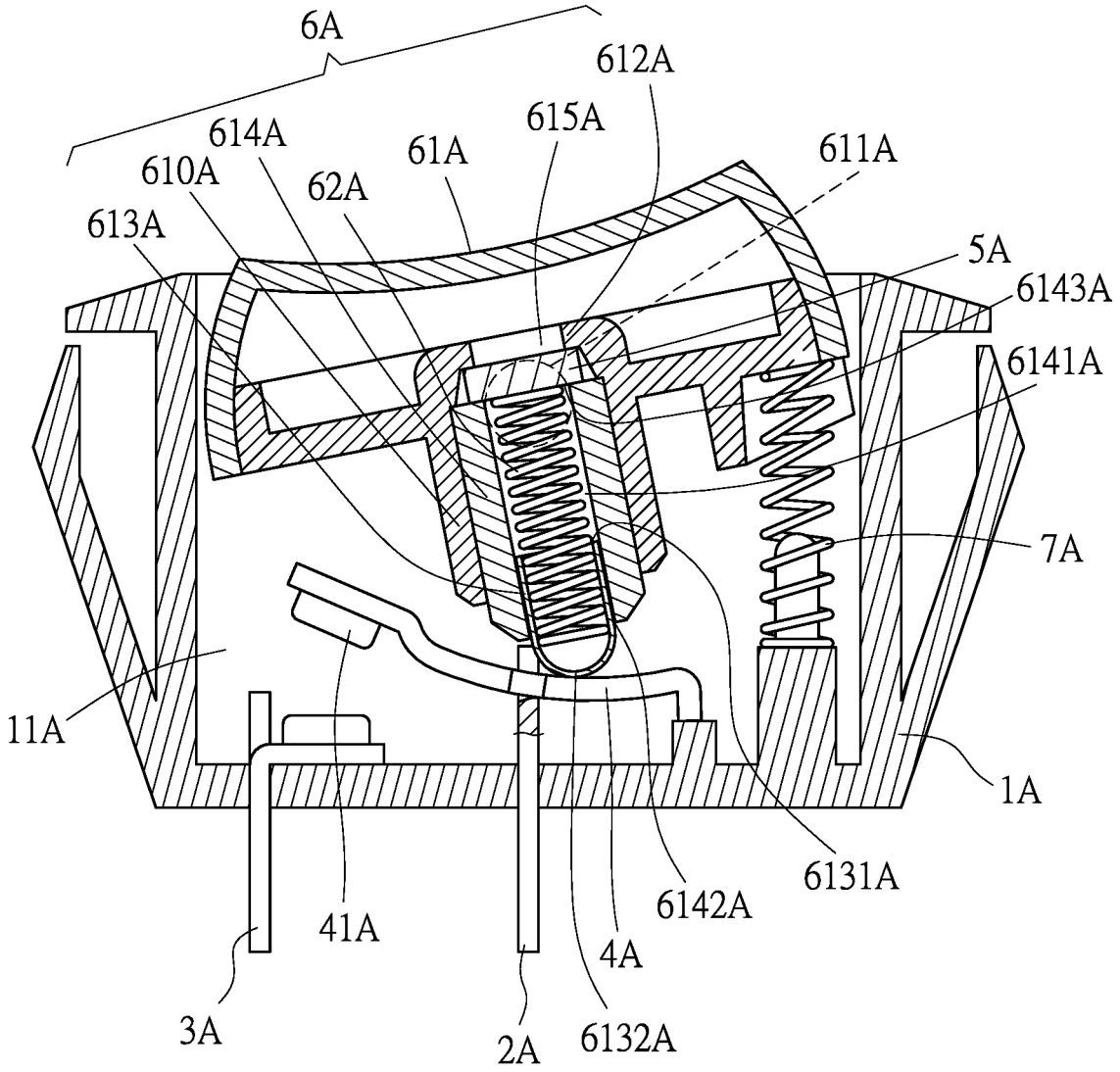
FIG. 1 is a schematic view of a first embodiment of the present invention, and shows a seesaw switch structure with the seesaw switch in a closed position.

Referring to FIG. 1, which shows a first embodiment of the present invention, wherein a heat destructive disconnecting switch of the present embodiment is a seesaw switch, and FIG. 1 depicts the seesaw switch in a closed state. The seesaw switch comprises:

A base (1A), which is provided with a holding space (11A); a first conductive member (2A) and a second conductive member (3A), both of which penetrate and are mounted on the base (1A); a movable conductive member, which is mounted within the holding space (11A), wherein the movable conductive member is a conductive seesaw member (4A) that astrides and is mounted on the first conductive member (2A) and electrically connected to the first conductive member (2A); and an overheating destructive member (5A), which is destructed under a fail temperature condition, the fail temperature lying between 100° C. to 250° C. The overheating destructive member (5A) is not used to maintain the continued supply of electric current; therefore, insulating material such as plastic or non-insulating material made of a low-melting alloy, or low-melting metals can be used. The aforementioned low-melting alloys include an alloy of bismuth and any one of or a composition from a plurality of the metals cadmium, indium, silver, tin, lead, antimony, or copper; or other low-melting metals or alloys with melting points lying between 100° C. to 250° C. In the present embodiment, the overheating destructive member (5A) is a circular disk; however, other forms, such as a cylindrical body, a cap, a block, a spherical body, an irregular shaped body, or a radial shaped plate are also suitable embodiments.

When there is a temperature anomaly rise in the operating temperature, it is preferred that a live wire triggers a circuit break, hence the first conductive member (2A) in use is a live wire first end, and the second conductive member (3A) in use is a live wire second end, with the conductive seesaw member (4A) used to conduct electricity to the first conductive member (2A) and the second conductive member (3A) to form a live wire closed circuit.

The seesaw switch of the present embodiment is further provided with an operating component (6A), which is used to operate the conductive seesaw member (4A) to connect with the first conductive member (2A) and the second conductive member (3A) to form a live wire closed circuit or disconnect the first conductive member (2A) from the second conductive member (3A), causing the live wire to form an open circuit. The operating component (6A) is assembled on the base (1A) and comprises an operating member (61A) and a first elastic member (62A). The operating member (61A) is provided with a pivot connecting point (611A) that is pivot connected to the base (1A), which enables the operating member (61A) to use the pivot connecting point (611A) as an axis and limit to and fro motion thereon. The operating member (61A) further comprises a contact member, a central cylinder (610A), an inner cylinder (614A), and a limiting member (612A), wherein the contact member is a hollow shaped heat conducting member (613A) that comprises an open end (6131A) and a curved contact end (6132A). The contact end (6132A) of the heat conducting member (613A) contacts the conductive seesaw member (4A), and a through hole (615A) is provided in the end of the central cylinder (610A) away from where the conductive seesaw member (4A) is positioned. The above-described limiting member (612A) is positioned on the peripheral edge of the through hole (615A), and the central cylinder (610A) is tightly fitted on the above-described inner cylinder (614A). The inner cylinder (614A) is provided with a penetrating retaining space (6141A), and the first elastic member (62A) is inserted within the retaining space (6141A). The two ends of the retaining space (6141A) are respectively provided with a first opening (6142A) and a second opening (6143A). The heat conducting member (613A) partially penetrates into the retaining space (6141A) and partially extends out through the first opening (6142A). The diameter of the through hole (615A) is larger than the width of the first elastic member (62A), and one end of the first elastic member (62A) extends into the open end (6131A) of the heat conducting member (613A). The overheating destructive member (5A) butts against the limiting member (612A), with the first elastic member (62A) compressed and confined between heat conducting member (613A) and the overheating destructive member (5A), which provides the first elastic member (62A) with a first elastic force.

The seesaw switch of the present embodiment is further provided with a second elastic member (7A), which, in the present embodiment, is a spring. The second elastic member (7A) is provided with a second elastic force that acts on the operating member (61A).

Figure 2:
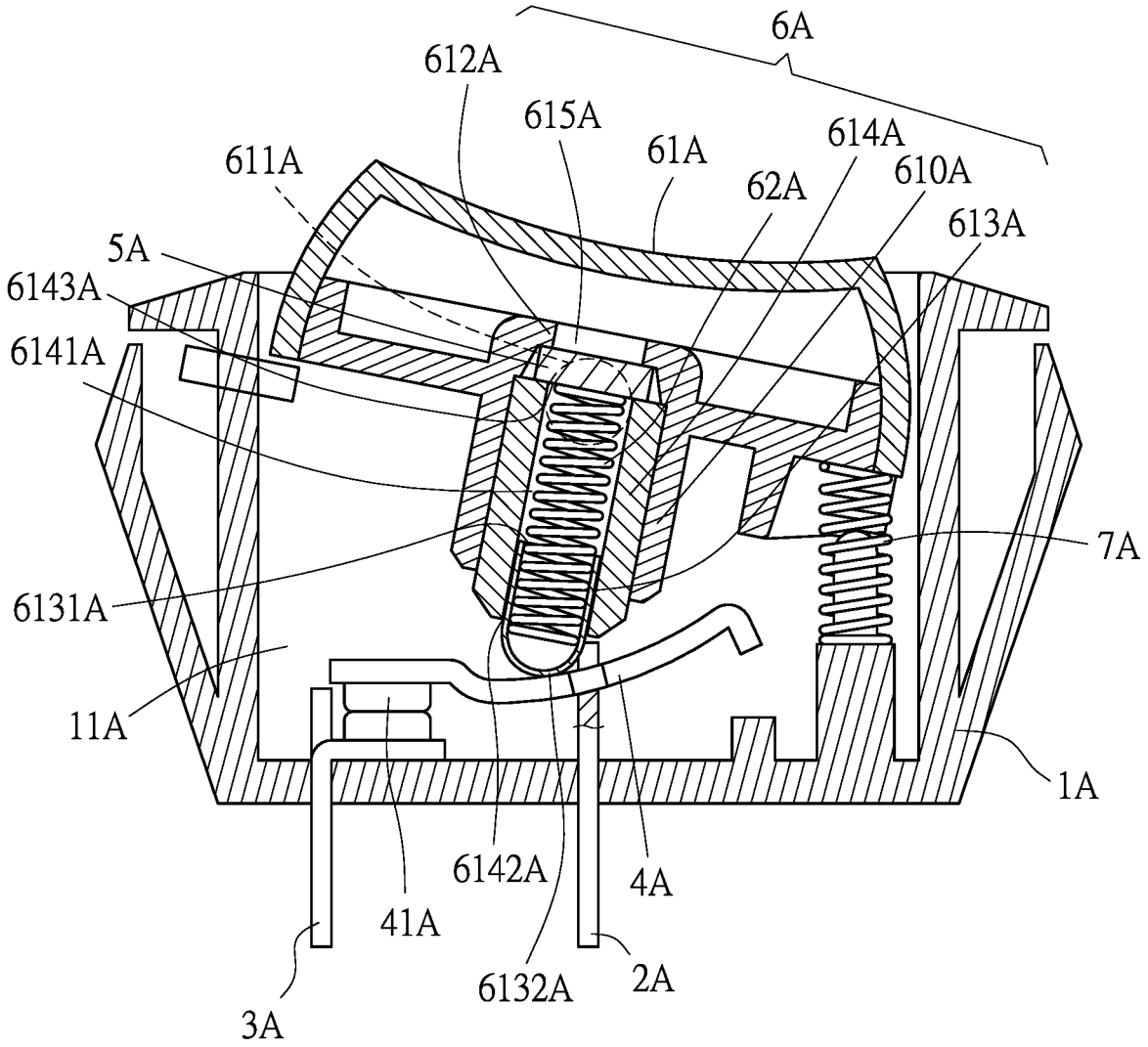
FIG. 2 is a schematic view of the first embodiment of the present invention, and shows the seesaw switch in an open position.

Referring to FIG. 2, a user toggles the operating member (61A) to and fro on the pivot connecting point (611A), which causes the heat conducting member (613A) to slide on the conductive seesaw member (4A) and drive the conductive seesaw member (4A) in a seesaw movement to selectively contact or separate from the second conductive member (3A). When the heat conducting member (613A) is caused to slide on the conductive seesaw member (4A) in the direction of a silver contact point (41A) on the conductive seesaw member (4A), the first elastic force forces the silver contact point (41A) to contact the second conductive member (3A) and form a power-on state.

Figure 3:
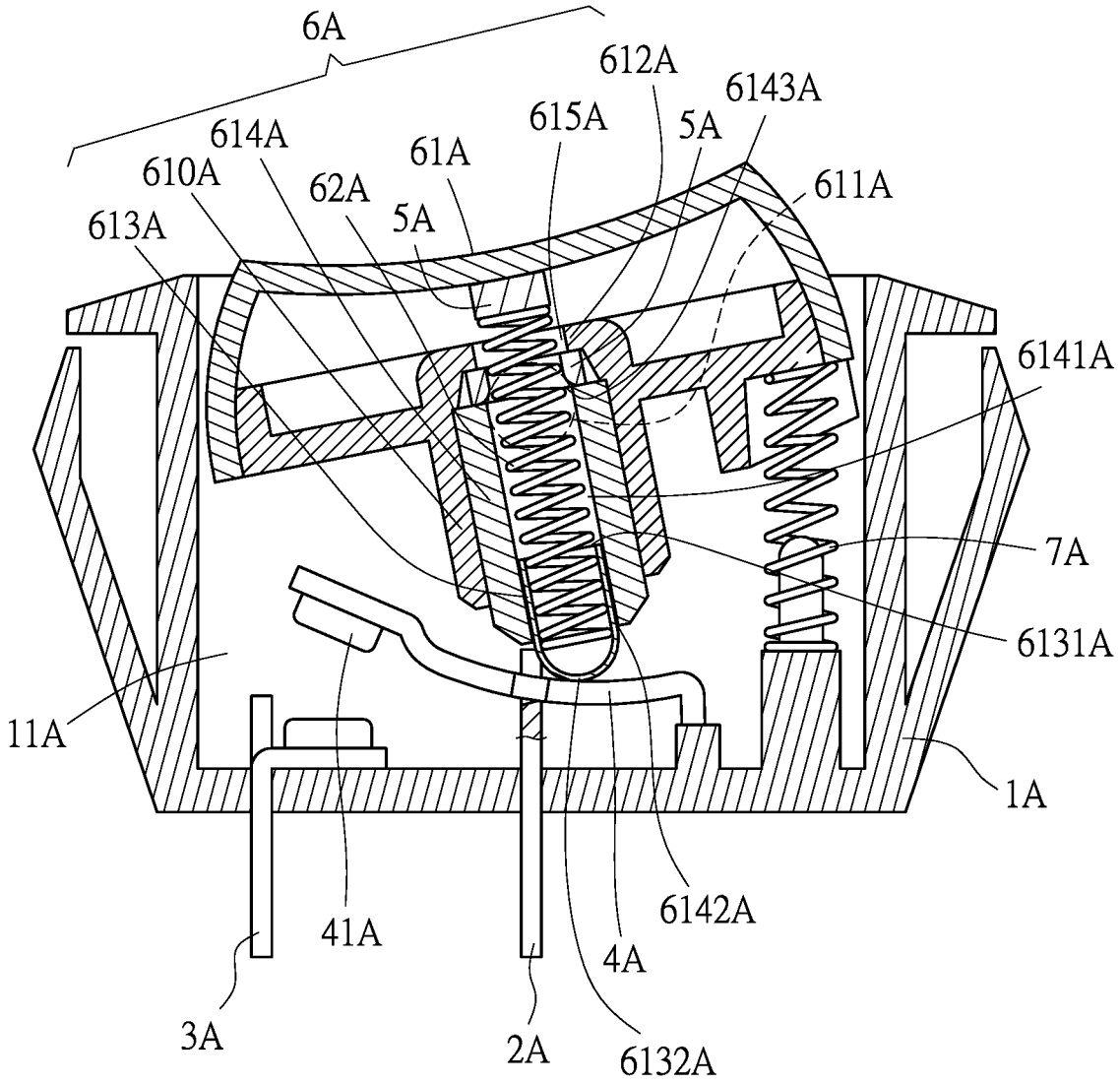
FIG. 3 is a schematic view of the first embodiment of the present invention, and shows, when an overheating destructive member is destructed due to overheating, a movable conductive member separated from a second conductive member, causing the seesaw switch to revert to a closed position from an open position and form an open circuit.

Referring to FIG. 3, when an abnormal condition occurs in an external electric equipment connected to the first conductive member (2A) or the second conductive member (3A); for example, the external electric equipment is a plug socket, oxides or dust present between the metal pins of a plug and the plug socket, or phenomena such as incomplete insertion of the metal pins or distorted metal pins will produce relatively large amounts of heat energy in the electrical conducting portions of the plug socket, whereupon, the first conductive member (2A) or the second conductive member (3A) transfers the heat energy to the conductive seesaw member (4A) and then through the heat conducting member (613A) to the first elastic member (62A), which then transfers the heat to the overheating destructive member (5A). The overheating destructive member (5A) absorbs the heat energy up to the melting point thereof, at which time the overheating destructive member (5A) begins to gradually lose its rigidity. For example, if the material of the overheating destructive member (5A) is a tin-bismuth alloy, although the melting point thereof is 138° C., the tin-bismuth alloy begins to lose its rigidity when the temperature is close to its melting point, and under the concurrent effect of the first elastic force, the overheating destructive member (5A) is pressed and deformed by the first elastic member (62A) to the extent of being destructed. In the present embodiment, the overheating destructive member (5A) shown in FIG. 1 has been destructed and broken into two portions to become the state shown in FIG. 3, which causes the first elastic member (62A) to elongate and penetrate the overheating destructive member (5A), thereby protruding through the through hole (615A) and resulting in lessening or loss of the first elastic force, at which time the second elastic force will be larger than the first elastic force. In the present embodiment, the arrangement of the first conductive member (2A) and the second conductive member (3A) is defined as being in a lengthwise direction. The operating member (61A) has a length in the lengthwise direction, and the first elastic member (62A) is disposed at the central position of the length. There is a distance between the disposed position of the second elastic member (7A) and the central position, hence, when the second elastic force is larger than the first elastic force, a torque effect forces the operating member (61A) to rotate on the pivot connecting point (611A) as an axis, which causes the heat conducting member (613A) to slide on the conductive seesaw member (4A) and drive the operating member (61A) to displace and form a closed position. Accordingly, the silver contact point (41A) of the conductive seesaw member (4A) separates from the second conductive member (3A) to form a power-off state, thereby achieving the protective effect against overheating.

Figure 4:
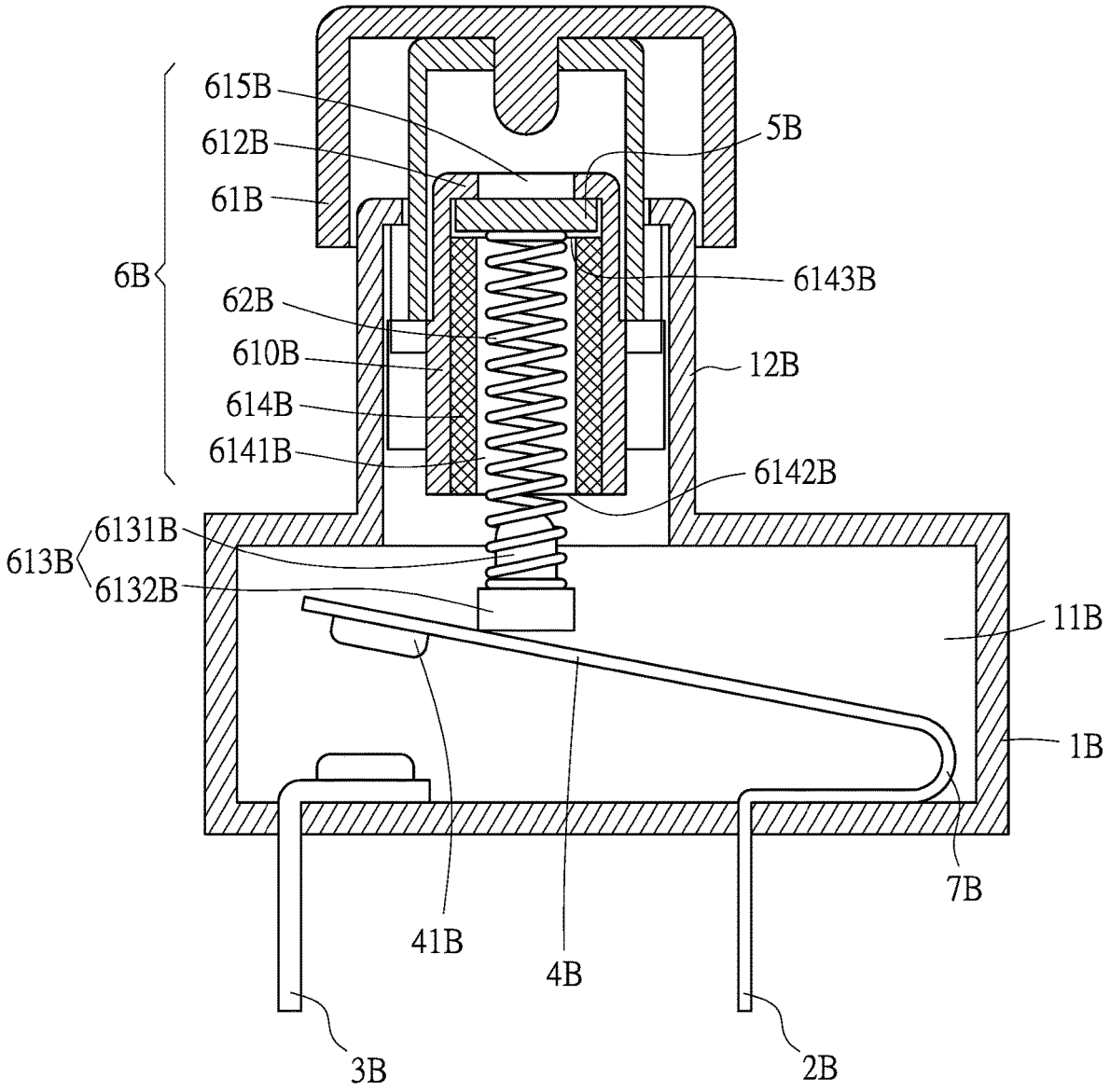
FIG. 4 is a schematic view of a second embodiment of the present invention, and shows a press switch structure with the press switch in a closed position.

Referring to FIG. 4, which shows a second embodiment of the present invention, wherein the heat destructive disconnecting switch of the present embodiment is a press switch, and FIG. 4 depicts the press switch in a closed state. The press switch comprises:

A base (1B), which is provided with a holding space (11B) and a protruding portion (12B); a first conductive member (2B) and a second conductive member (3B), both of which penetrate and are mounted on the base (1B); a movable conductive member, which is mounted within the holding space (11B), wherein the movable conductive member is a conductive cantilever member (4B); and an overheating destructive member (5B), which is destructed under a fail temperature condition, the fail temperature lying between 100° C. to 250° C. Because the overheating destructive member (5B) is not used to maintain the continued supply of electric current, thus, insulating material such as plastic or non-insulating material made of a low-melting alloy, such as an alloy of bismuth and any one of or a composition from a plurality of the metals cadmium, indium, silver, tin, lead, antimony, or copper; or other low-melting metals or alloys with melting points lying between 100° C. to 250° C. can be used. In the present embodiment, the overheating destructive member (5B) is a circular disk; however, other forms such as a rod, cap, radial shaped body, block, spherical body, or an irregular shaped body are also suitable embodiments.

When there is a temperature anomaly rise in the operating temperature, it is preferred that a live wire triggers a circuit break, hence, the first conductive member (2B) in use is a live wire first end, the second conductive member (3B) in use is a live wire second end, and the conductive cantilever member (4B) is used to conduct current to the first conductive member (2B) and the second conductive member (3B) to form a live wire closed circuit.

The press switch of the present embodiment is further provided with an operating component (6B), which is used to operate the conductive cantilever member (4B) to connect with the first conductive member (2B) and the second conductive member (3B) to form a live wire closed circuit or disconnect the first conductive member (2B) from the second conductive member (3B), causing the live wire to form an open circuit. The operating component (6B) is assembled on the base (1B) and comprises an operating member (61B) and a first elastic member (62B). The operating member (61B) is assembled on the protruding portion (12B) and has limited up and down displacement thereon. The up and down displacement and positioning structure of the entire operating component (6B) is the same as the press button structure of an automatic ball-point pen of the prior art, such as the prior art structure of a "Push-button switch" disclosed in China Patent No. CN103441019, thus, the drawings of the present embodiment omit illustrating a number of structural positions disclosed in the prior art. The operating member (61B) further comprises a contact member, a central cylinder (610B), an inner cylinder (614B), and a limiting member (612B). A through hole (615B) is provided at the end of the central cylinder (610B) away from where the conductive cantilever member (4B) is positioned, and the limiting member (612B) is positioned on the peripheral edge of the through hole (615B). The central cylinder (610B) is tightly fitted on the inner cylinder (614B), the inner cylinder (614B) is provided with a penetrating retaining space (6141B), and the first elastic member (62B) is inserted within the retaining space (6141B). Two ends of the retaining space (6141B) are respectively provided with a first opening (6142B) and a second opening (6143B). The contact member is a supporting heat conducting member (613B), which is positioned close to the first opening (6142B). The diameter of the through hole (615B) is larger than the width of the first elastic member (62B). The supporting heat conducting member (613B) is provided with a limiting post (6131B) and a supporting base (6132B), wherein the limiting post (6131B) extends into the end of the first elastic member (62B), causing the first elastic member (62B) to butt against the top of the supporting base (6132B), and the supporting base (6132B) further contacts the conductive cantilever member (4B). The overheating destructive member (5B) butts against the limiting member (612B), with the first elastic member (62B) compressed and confined between the supporting heat conducting member (613B) and the overheating destructive member (5B), thereby providing the first elastic member (62B) with a first elastic force.

The press switch of the present embodiment is further provided with a second elastic member, which is a spring plate (7B), with the first conductive member (2B), the spring plate (7B), and the conductive cantilever member (4B) are formed as an integral body. The spring plate (7B) is provided with a second elastic force that acts on the operating member (61B).

Figure 5:
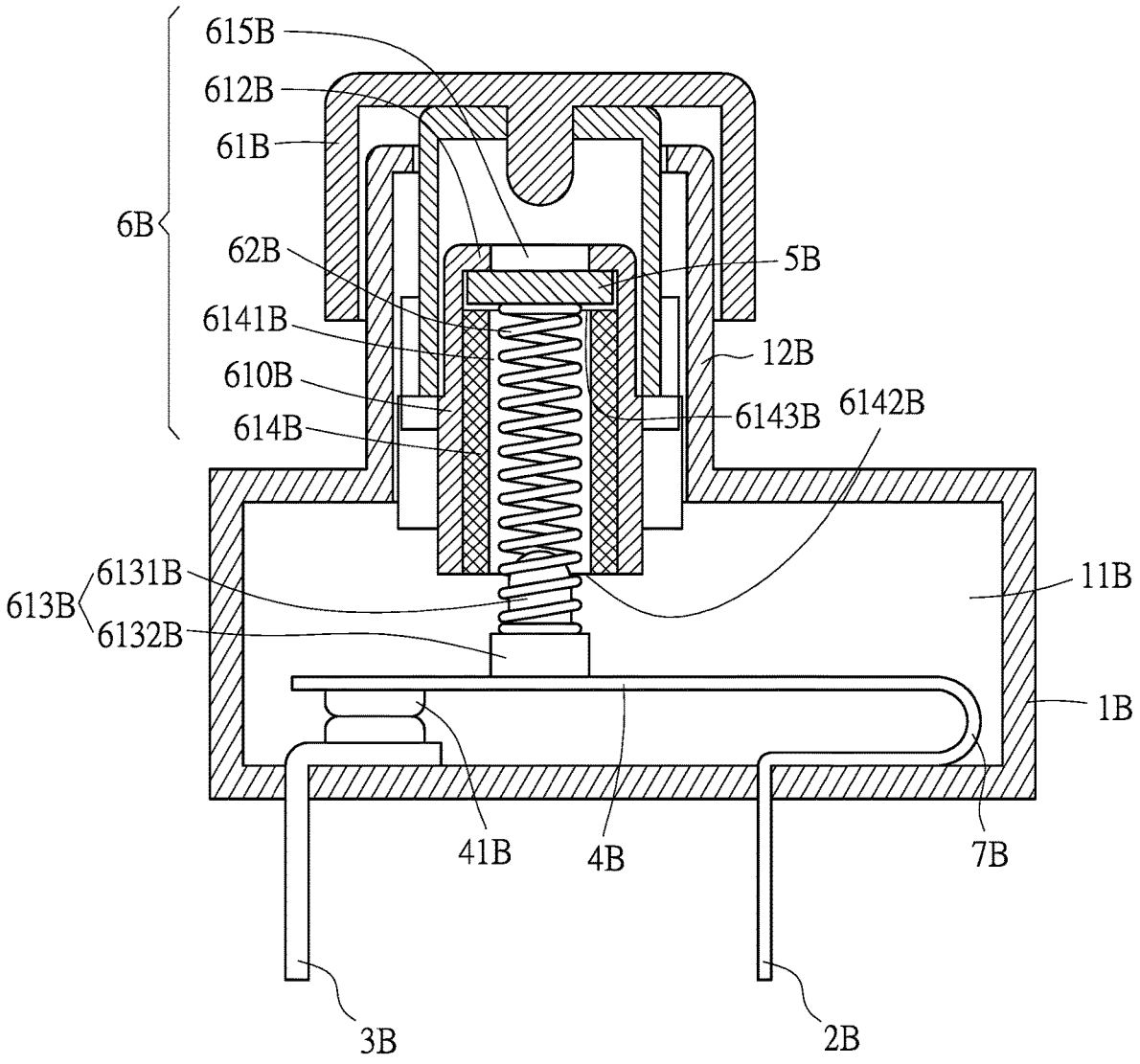
FIG. 5 is a schematic view of the second embodiment of the present invention, and shows the press switch in an open position.

Referring to FIG. 5, a user is places the operating member (61B) relative to the protruding portion (12B), similar to pressing the button on an automatic ball-point pen, causing the conductive cantilever member (4B) to selectively contact or separate from the second conductive member (3B). When the operating member (61B) is displaced in the direction of the conductive cantilever member (4B) and positioned relative thereto, the supporting base (6132B) of the supporting heat conducting member (613B) is caused to press a position close to a silver contact point (41B) of the conductive cantilever member (4B), causing the conductive cantilever member (4B) to contact the second conductive member (3B) and form a power-on state, at which time the first elastic member (62B) is further compressed, which enlarges the first elastic force thereof to an extent larger than the second elastic force.

Figure 6:
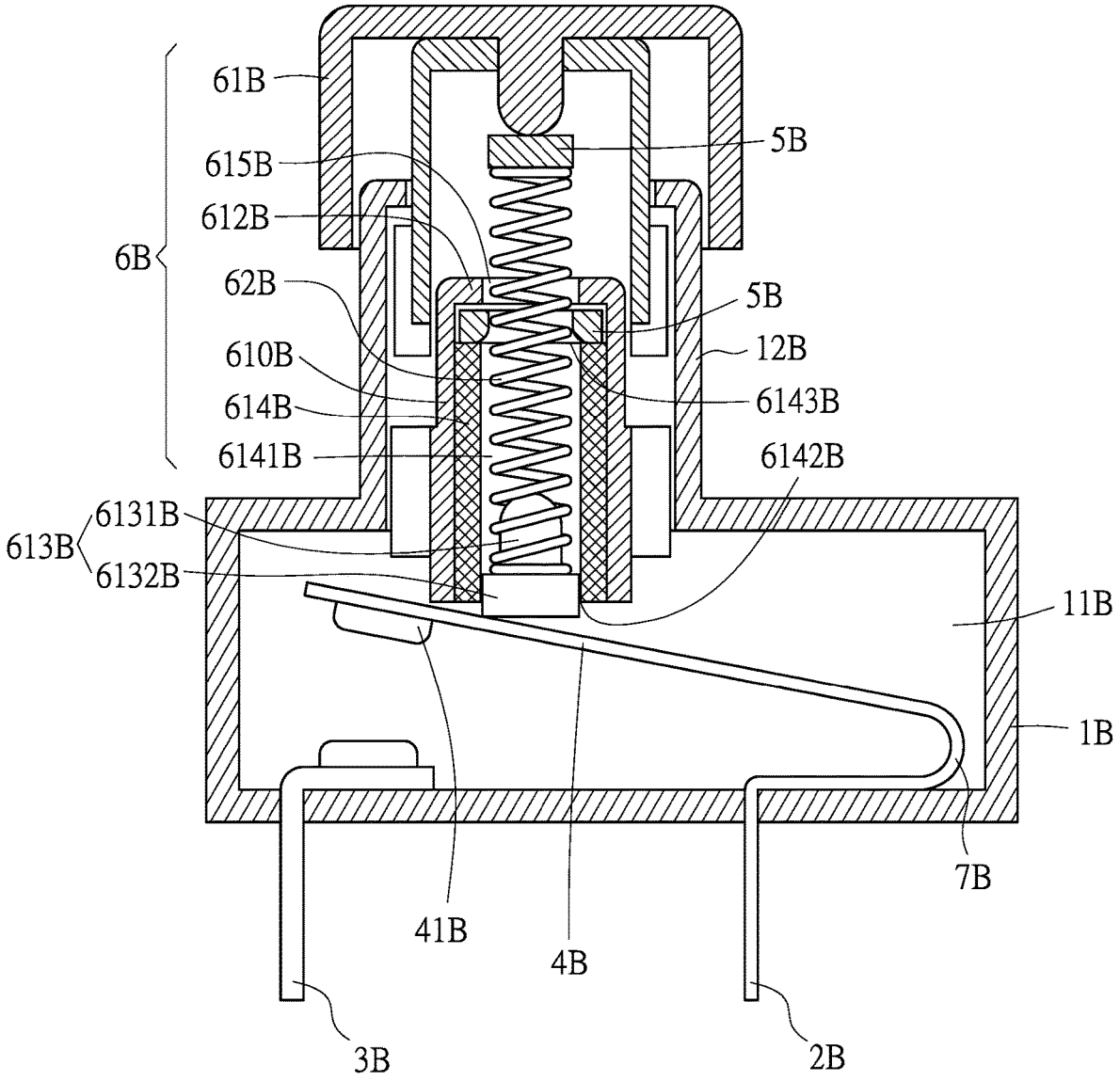
FIG. 6 is a schematic view of the second embodiment of the present invention, and shows, when an overheating destructive member is destructed due to overheating, a movable conductive member separated from a second conductive member to form an open circuit.

Referring to FIG. 6, when an abnormal condition occurs in an external electric equipment connected to the first conductive member (2B) or the second conductive member (3B), for example, the external electric equipment is a plug socket, oxides or dust present between the metal pins of the plug and the plug socket, or incomplete insertion of the metal pins or distorted metal pins will produce relatively large amounts of heat energy in the electrical conducting portions of the plug socket, whereupon, the first conductive member (2B) or the second conductive member (3B) transfers the heat energy to the conductive cantilever member (4B) and then through the supporting base (6132B) of the supporting heat conducting member (613B), the limiting post (6131B), and the first elastic member (62B) to the overheating destructive member (5B). The overheating destructive member (5B) gradually absorbs the heat energy up to the melting point thereof, at which time the overheating destructive member (5B) begins to gradually lose its rigidity. For example, if the material of the overheating destructive member (5B) is a tin-bismuth alloy, although the melting point thereof is 138° C., the tin-bismuth alloy begins to lose its rigidity when the temperature is close to its melting point, and under the concurrent effect of the first elastic force, the overheating destructive member (5B) is pressed and deformed by the first elastic member (62B) to the extent of being destructed and is no longer able to restrain the first elastic member (62B). In the present embodiment, the overheating destructive member (5B) shown in FIG. 4, having been destructed and broken into two portions has become the state shown in FIG. 6, which causes the first elastic member (62B) to elongate and penetrate the overheating destructive member (5B), thereby protruding through the through hole (615B), resulting in lessening or loss of the first elastic force. Consequently, the second elastic force is larger than the first elastic force, forcing the conductive cantilever member (4B) to restore its original unpressed state and causing the silver contact point (41B) of the conductive cantilever member (4B) to separate from the second conductive member (3B) to form a power-off state, thereby achieving the protective effect against overheating.

Figure 7:
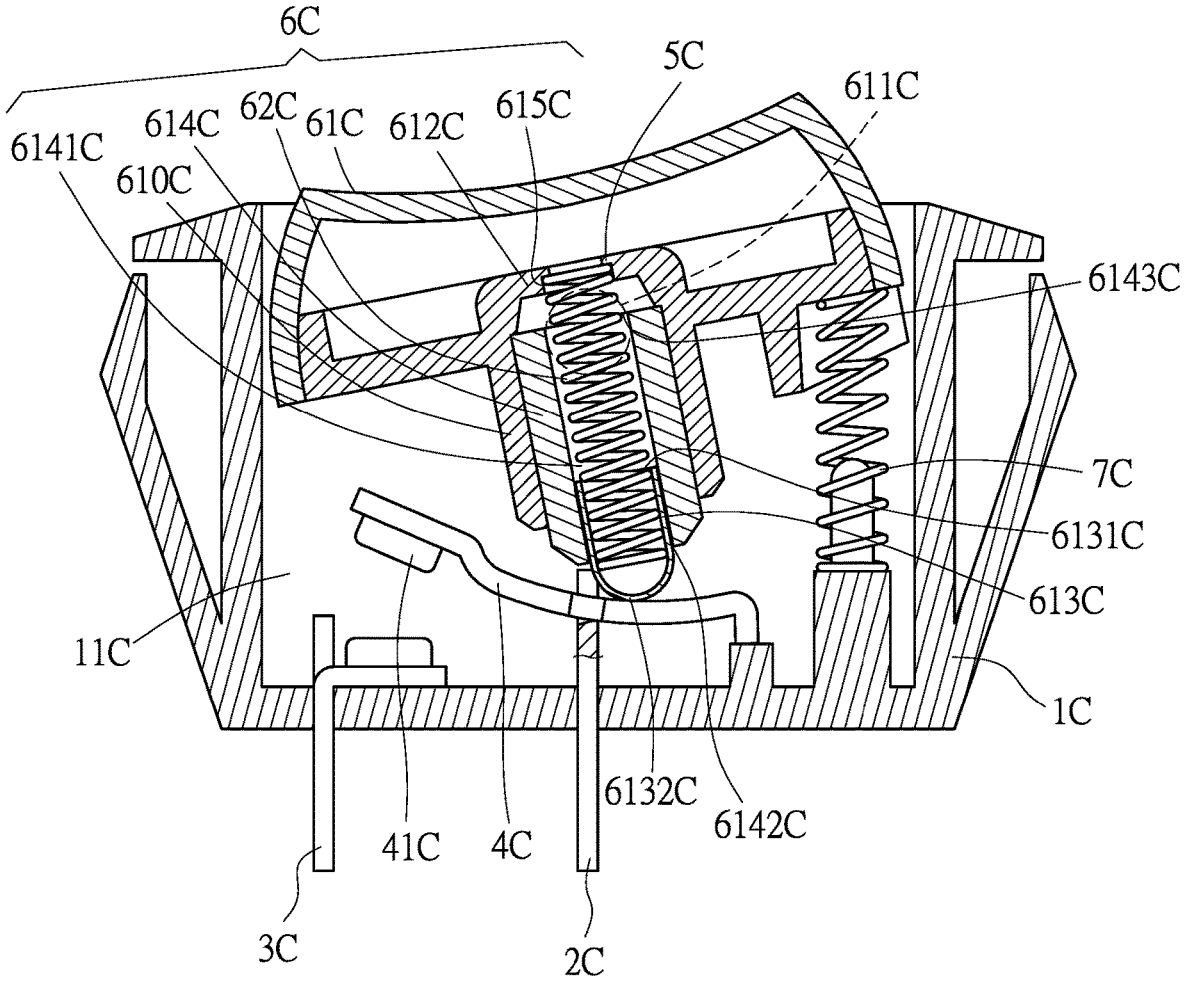
FIG. 7 is a schematic view of a third embodiment of the present invention, and shows a seesaw switch structure with the seesaw switch in a closed position.

Referring to FIG. 7, which shows a third embodiment of the present invention, wherein the heat destructive disconnecting switch of the present embodiment is a seesaw switch, and FIG. 7 depicts the seesaw switch in a closed state. The seesaw switch comprises:

A base (1C), which is provided with a holding space (11C); a first conductive member (2C) and a second conductive member (3C), both of which penetrate and are mounted on the base (1C); a movable conductive member, which is mounted within the holding space (11C), wherein the movable conductive member is a conductive seesaw member (4C) that astrides and is mounted on the first conductive member (2C) and electrically connected thereto; and an overheating destructive member (5C) that is destructed under a fail temperature condition, the fail temperature lying between 100° C. to 250° C. The overheating destructive member (5C) is not used to maintain the continued supply of electric current; therefore, insulating material such as plastic or non-insulating material made of a low-melting alloy, such as an alloy of bismuth and any one of or a composition from a plurality of the metals cadmium, indium, silver, tin, lead, antimony, or copper; or other low-melting metals or alloys with melting points lying between 100° C. to 250° C., such as a tin-bismuth alloy with a melting point around 138° C. can be used.

When there is a temperature anomaly rise in the operating temperature, it is preferred that a live wire triggers a circuit break. Therefore, the first conductive member (2C) in use is a live wire first end, the second conductive member (3C) in use is a live wire second end, and the conductive seesaw member (4C) is used to enable electrical conduction with the first conductive member (2C) and the second conductive member (3C) to form a live wire closed circuit.

The seesaw switch of the present embodiment is further provided with an operating component (6C), which is used to operate the conductive seesaw member (4C) to connect with the first conductive member (2C) and the second conductive member (3C) to form a live wire closed circuit, or disconnect the circuit between the first conductive member (2C) and the second conductive member (3C), causing the live wire to form an open circuit. The operating component (6C) is assembled on the base (10) and comprises an operating member (61C) and a first elastic member (62C), wherein the operating member (61C) provides a press surface as a nonconductor. The operating member (61C) is also provided with a pivot connecting point (611C), which is pivot connected to the base (10) to enable the operating member (61C) to use the pivot connecting point (611C) as an axis and limit back and forth rotation. The operating member (61C) further comprises a contact member, a central cylinder (610C), an inner cylinder (614C), and a limiting member (612C). The contact member is a hollow shaped heat conducting member (613C), which comprises an open end (6131C) and a curved contact end (6132C). The contact end (6132C) of the heat conducting member (613C) contacts the conductive seesaw member (4C). The limiting member (612C) and a through hole (615C) are provided in the end of the central cylinder (610C) away from the conductive seesaw member (4C), and the central cylinder (610C) is tightly fitted on the inner cylinder (614C). The inner cylinder (614C) is provided with a penetrating retaining space (6141C), and the first elastic member (62C) is inserted within the retaining space (6141C). Two ends of the retaining space (6141C) are respectively provided with a first opening (6142C) and a second opening (6143C). The heat conducting member (613C) partially penetrates into the retaining space (6141C) and partially extends out from the first opening (6142C). The overheating destructive member (5C) is formed as an integral body on the limiting member (612C) and positioned on the peripheral edge of the through hole (615C). The diameter of the through hole (615C) is larger than the width of the first elastic member (62C), and one end of the first elastic member (62C) extends into the open end (6131C) of the heat conducting member (613C). Moreover, restriction by the overheating destructive member (5C) that has not yet been destructed is used to compress and confine the first elastic member (62C) between the heat conducting member (613C) and the overheating destructive member (5C), thereby providing the first elastic member (62C) with a first elastic force.

The seesaw switch of the present embodiment is further provided with a second elastic member (7C), which, in the present embodiment, is a spring. The second elastic member (7C) is provided with a second elastic force that acts on the operating member (61C).

Figure 8:
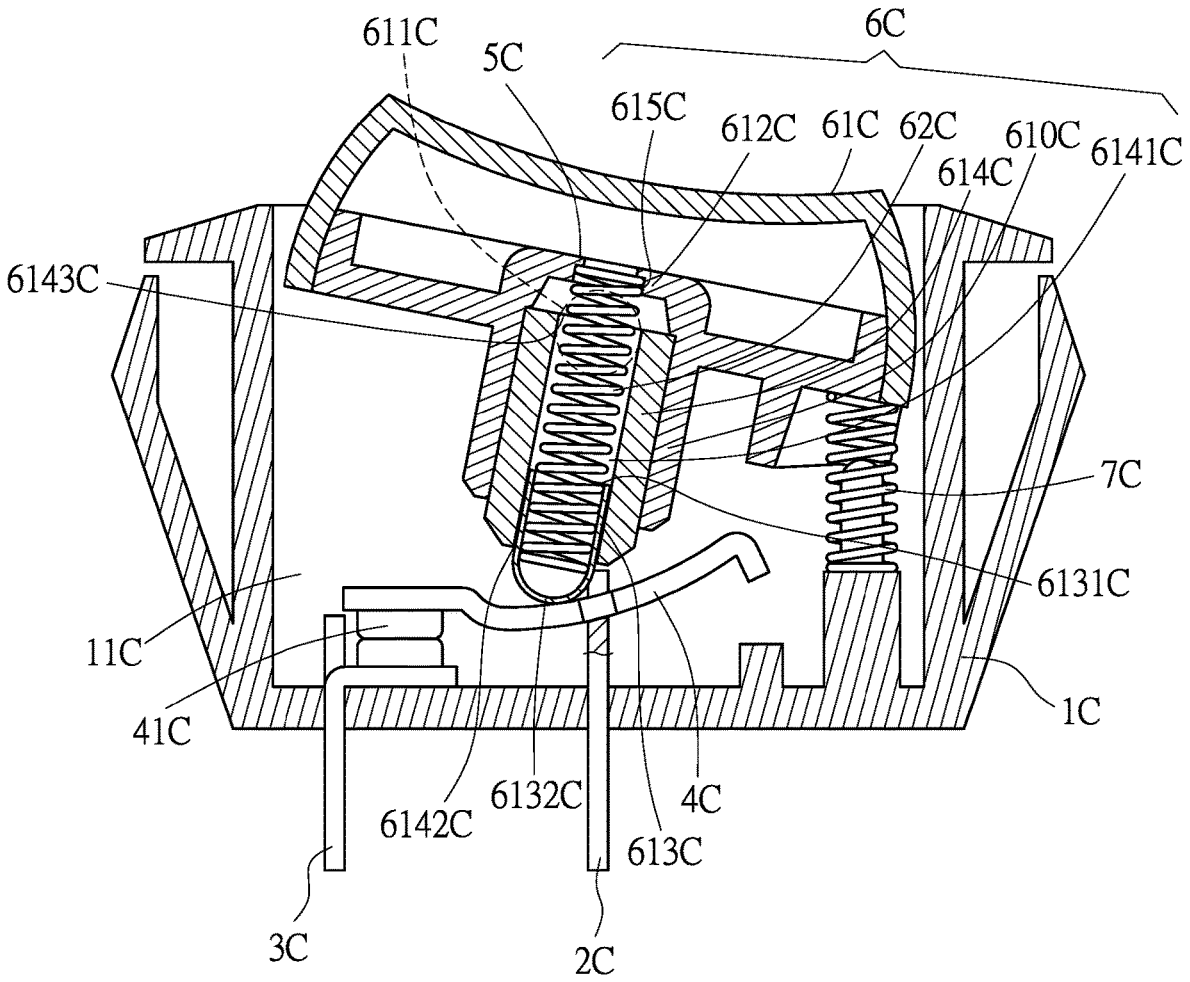
FIG. 8 is schematic view of the third embodiment of the present invention, and shows the seesaw switch in an open position.

Referring to FIG. 8, a user toggles the operating member (61C) back and forth around the pivot connecting point (611C), which causes the heat conducting member (613C) to slide on the conductive seesaw member (4C), thereby enabling selective contact or separation of the conductive seesaw member (4C) from the second conductive member (3C) in a seesaw movement. When the heat conducting member (613C) is slid on the conductive seesaw member (4C) in the direction of a silver contact point (41C) on the conductive seesaw member (4C), the first elastic force forces the silver contact point (41C) to contact the second conductive member (3C) and form a power-on state.

Figure 9:
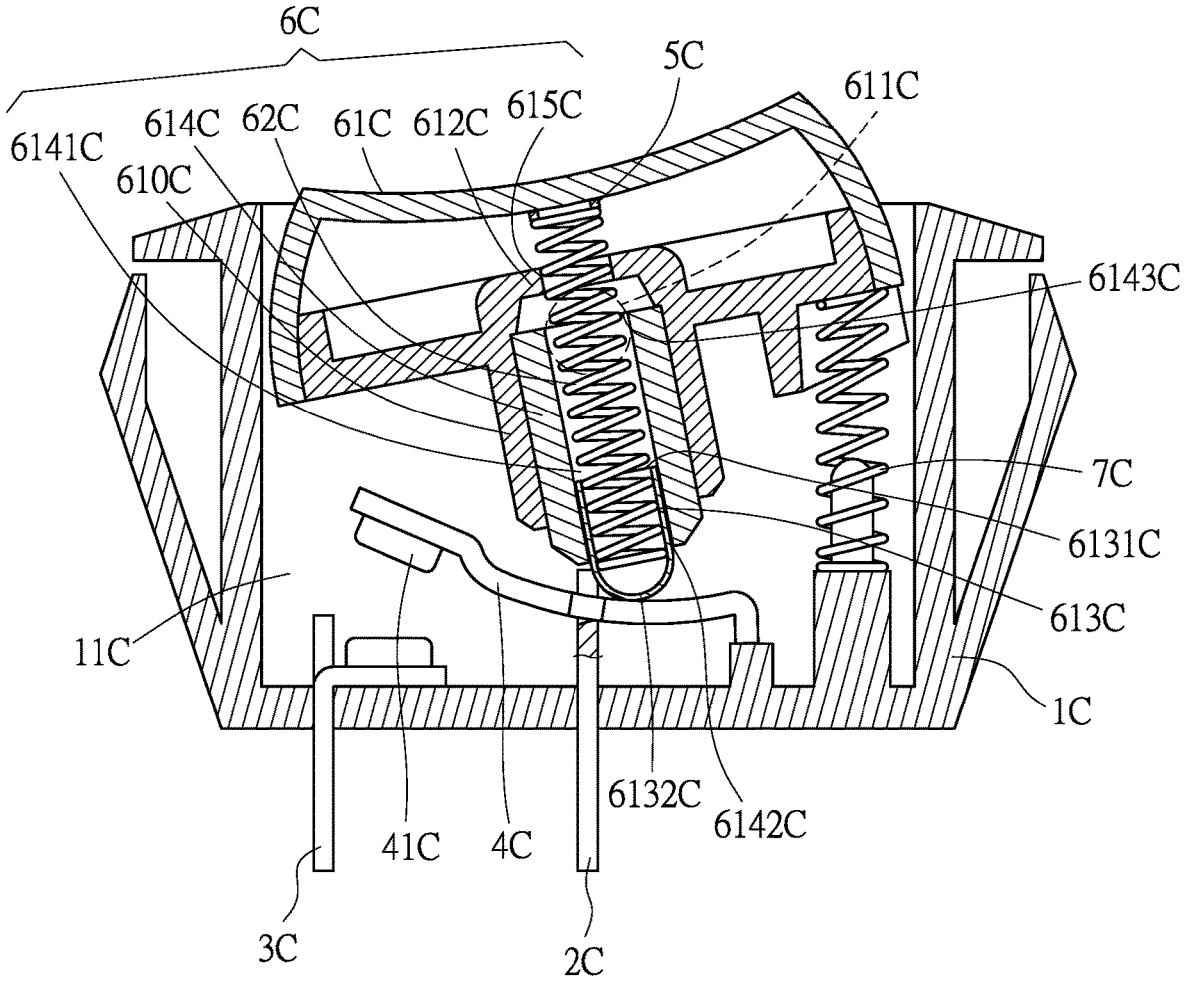
FIG. 9 is a schematic view of the third embodiment of the present invention, and shows, when an overheating destructive member is destructed due to overheating, a movable conductive member separated from a second conductive member, causing the seesaw switch to revert to a closed position from an open position and form an open circuit.

Referring to FIG. 9, when an abnormal condition occurs in an external electric equipment connected to the first conductive member (2C) or the second conductive member (3C), for example, the external electric equipment is a plug socket, oxides or dust present between the metal pins of a plug and the plug socket, or phenomena such as incomplete insertion of the metal pins or distorted metal pins will produce relatively large amounts of heat energy in the electrical conducting portions of the plug socket, whereupon the heat energy is transferred to the conductive seesaw member (4C) through the first conductive member (2C) or the second conductive member (3C), and then through the heat conducting member (613C) and the first elastic member (62C) to the overheating destructive member (5C). The overheating destructive member (5C) gradually absorbs the heat energy up to the melting point thereof, at which time the overheating destructive member (5C) begins to gradually lose its rigidity. For example, if the material of the overheating destructive member (5C) is a tin-bismuth alloy, although the melting point thereof is 138° C., the tin-bismuth alloy begins to lose its rigidity when the temperature is close to its melting point, and under the concurrent effect of the first elastic force, the overheating destructive member (5C) is compressed and deformed by the first elastic member (62C) to the extent of being destructed. This causes the first elastic member (62C) to break through the overheating destructive member (5C) and extend out through the through hole (615C), resulting in lessening or loss of the first elastic force, at which time the second elastic force is larger than the first elastic force. In the present embodiment, the arrangement of the first conductive member (2C) and the second conductive member (3C) is defined as being in a lengthwise direction, and the operating member (61C) has a length in the lengthwise direction. The first elastic member (62C) is disposed at the central position of the length. There is a distance between the disposed position of the second elastic member (7C) on the length and the central position; therefore, when the second elastic force is larger than the first elastic force, a torque effect forces the operating member (61C) to rotate on the pivot connecting point (611C) as an axis and slides the heat conducting member (613C) on the conductive seesaw member (4C), thereby forcing the operating member (61C) to displace and form a closed position. Accordingly, the silver contact point (41C) of the conductive seesaw member (4C) separates from the second conductive member (3C) to form a power-off state, thereby achieving the protective effect against overheating.

Figure 10:
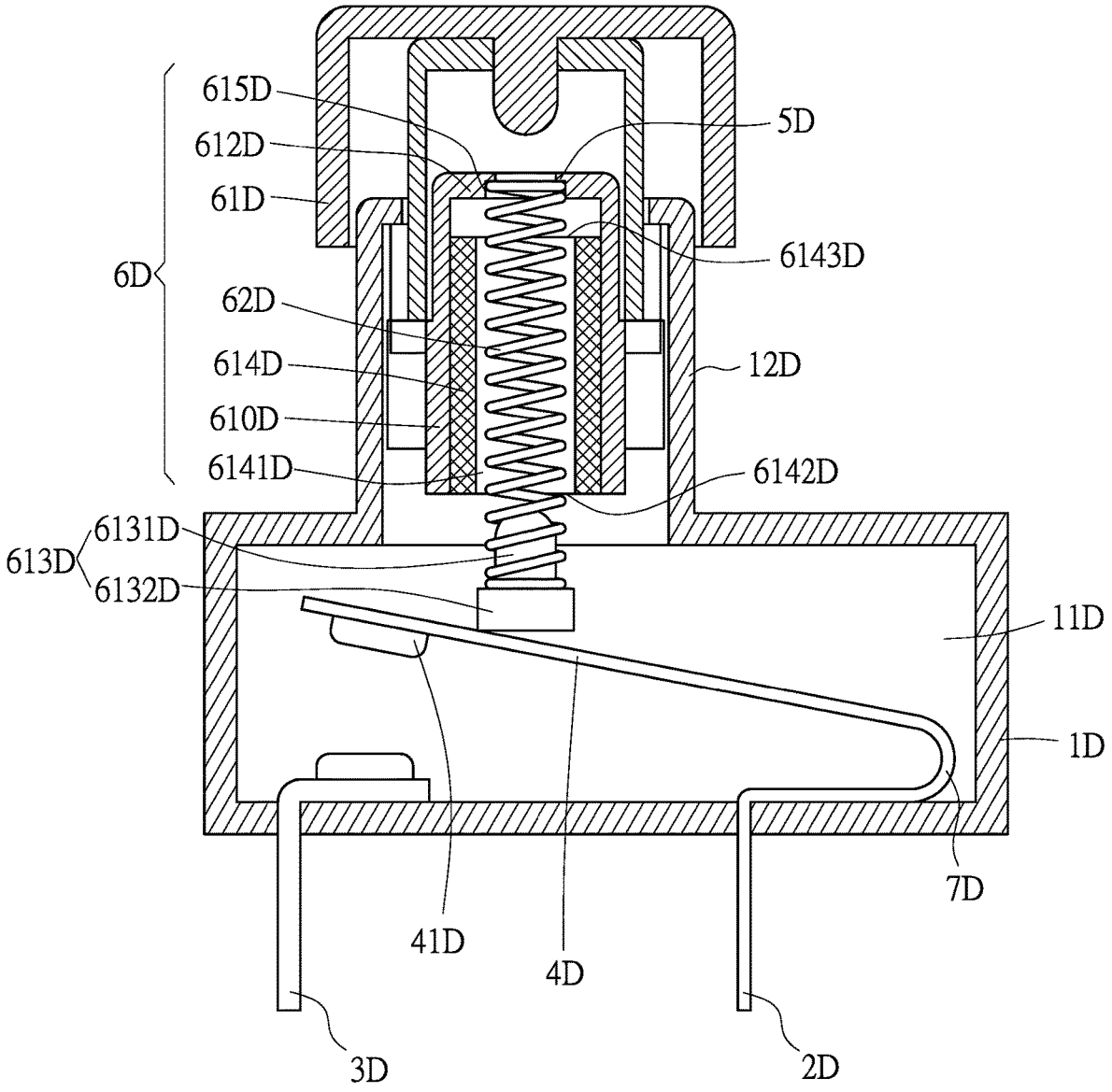
FIG. 10 is a schematic view of a fourth embodiment of the present invention, and shows a press switch structure with the press switch in a closed position.

Referring to FIG. 10, which shows a fourth embodiment of the present invention, wherein the heat destructive disconnecting switch of the present embodiment is a press switch. FIG. 10 shows the press switch in a closed state. The press switch comprises:

A base (1D), which is provided with a holding space (11D) and a protruding portion (12D); a first conductive member (2D) and a second conductive member (3D), both of which penetrate and are mounted on the base (1D); a movable conductive member, which is mounted within the holding space (11D), wherein the movable conductive member is a conductive cantilever member (4D); and an overheating destructive member (5D), which is destructed under a fail temperature condition, the fail temperature lying between 100° C. to 250° C. The overheating destructive member (5D) is not used to maintain the continued supply of electric current; therefore, insulating material such as plastic or non-insulating material made of a low-melting alloy, such as an alloy of bismuth and any one of or a composition from a plurality of the metals cadmium, indium, silver, tin, lead, antimony, or copper; or other low-melting metals or alloys with melting points lying between 100° C. to 250° C., such as a tin-bismuth alloy with a melting point around 138° C. can be used.

When there is a temperature anomaly rise in the operating temperature, it is preferred that a live wire triggers a circuit break. Therefore, the first conductive member (2D) in use is a live wire first end, the second conductive member (3D) in use is a live wire second end, and the conductive cantilever member (4D) is used to conduct current to the first conductive member (2D) and the second conductive member (3D) to form a live wire closed circuit.

The press switch of the present embodiment is further provided with an operating component (6D), which is used to operate the conductive cantilever member (4D) to connect with the first conductive member (2D) and the second conductive member (3D) to form a live wire closed circuit or disconnect the circuit between the first conductive member (2D) and the second conductive member (3D), causing the live wire to form an open circuit. The operating component (6D) is assembled on the base (1D) and comprises an operating member (61D) and a first elastic member (62D), wherein the operating member (61D) is mounted on the protruding portion (12D) and has limited up and down displacement thereon. The up and down displacement and positioning structure of the entire operating component (6D) is the same as the press button structure of an automatic ball-point pen of the prior art, such as the prior art structure of a "Push-button Switch" disclosed in China Patent No. CN103441019; therefore, the drawings of the present embodiment omit illustrating a number of structural positions disclosed in the prior art. The operating member (61D) further comprises a contact member, a central cylinder (610D), an inner cylinder (614D), and a limiting member (612D). The limiting member (612D) and a through hole (615D) are provided in the end of the central cylinder (610D) away from the conductive cantilever member (4D). The central cylinder (610D) is tightly fitted on the inner cylinder (614D), and the inner cylinder (614D) is provided with a penetrating retaining space (6141D). The first elastic member (62D) is inserted within the retaining space (6141D), and two ends of the retaining space (6141D) are respectively provided with a first opening (6142D) and a second opening (6143D). The contact member is a supporting heat conducting member (613D) that is installed at the first opening (6142D). The overheating destructive member (5D) is formed as an integral body on the limiting member (612D), and is positioned on the peripheral edge of the through hole (615D). The diameter of the through hole (615D) is larger than the width of the first elastic member (62D). The supporting heat conducting member (613D) is provided with a limiting post (6131D) and a supporting base (6132D), wherein the limiting post (6131D) extends into one end of the first elastic member (62D), causing the first elastic member (62D) to butt against the supporting base (6132D), thereby enabling the supporting base (6132D) to contact the conductive cantilever member (4D). Restriction by the overheating destructive member (5D) that has not yet been destructed is used to compress and confine the first elastic member (62D) between the supporting heat conducting member (613D) and the overheating destructive member (5D), thereby providing the first elastic member (62C) with a first elastic force. The press switch of the present embodiment is further provided with a second elastic member, which is a spring plate (7D). The first conductive member (2D), the spring plate (7D), and the conductive cantilever member (4D) are formed as an integral body. The spring plate (7D) is provided with a second elastic force that acts on the operating member (61D).

Figure 11:
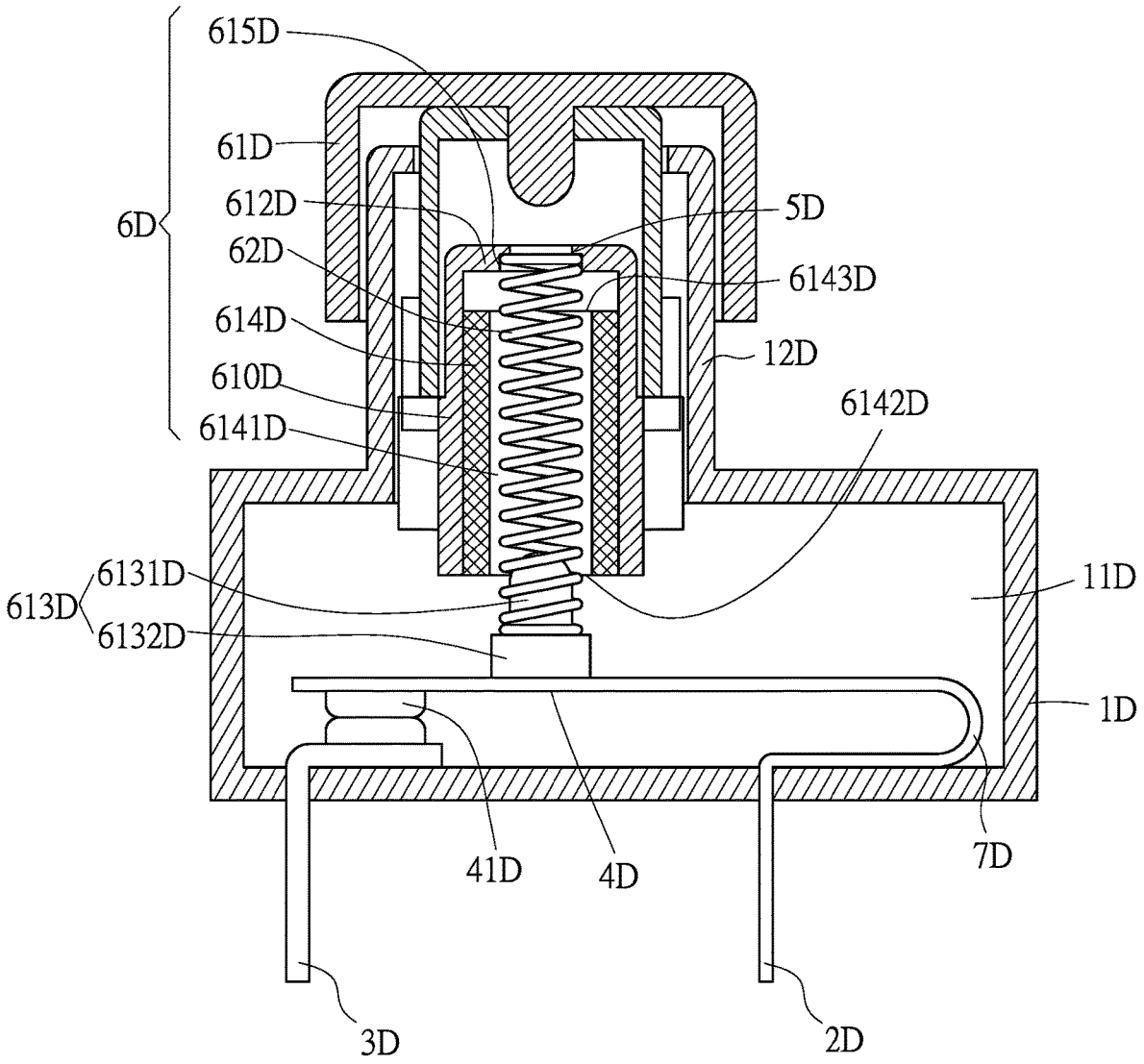
FIG. 11 is a schematic view of the fourth embodiment of the present invention, and shows the press switch in an open position.

Referring to FIG. 11, a user displaces the operating member (61D) relative to the protruding portion (12D), just like pressing the button on an automatic ball-point pen, which causes the conductive cantilever member (4D) to selectively contact or separate from the second conductive member (3D). When the operating member (61D) is displaced in the direction of the conductive cantilever member (4D) and positioned, the supporting base (6132D) of the supporting heat conducting member (613D) presses a position close to a silver contact point (41D) of the conductive cantilever member (4D), which causes the conductive cantilever member (4D) to contact the second conductive member (3D) and form a power-on state. At the same time, the first elastic member (62D) is further compressed, enlarging the first elastic force thereof, at which time the first elastic force is larger than the second elastic force.

Figure 12:
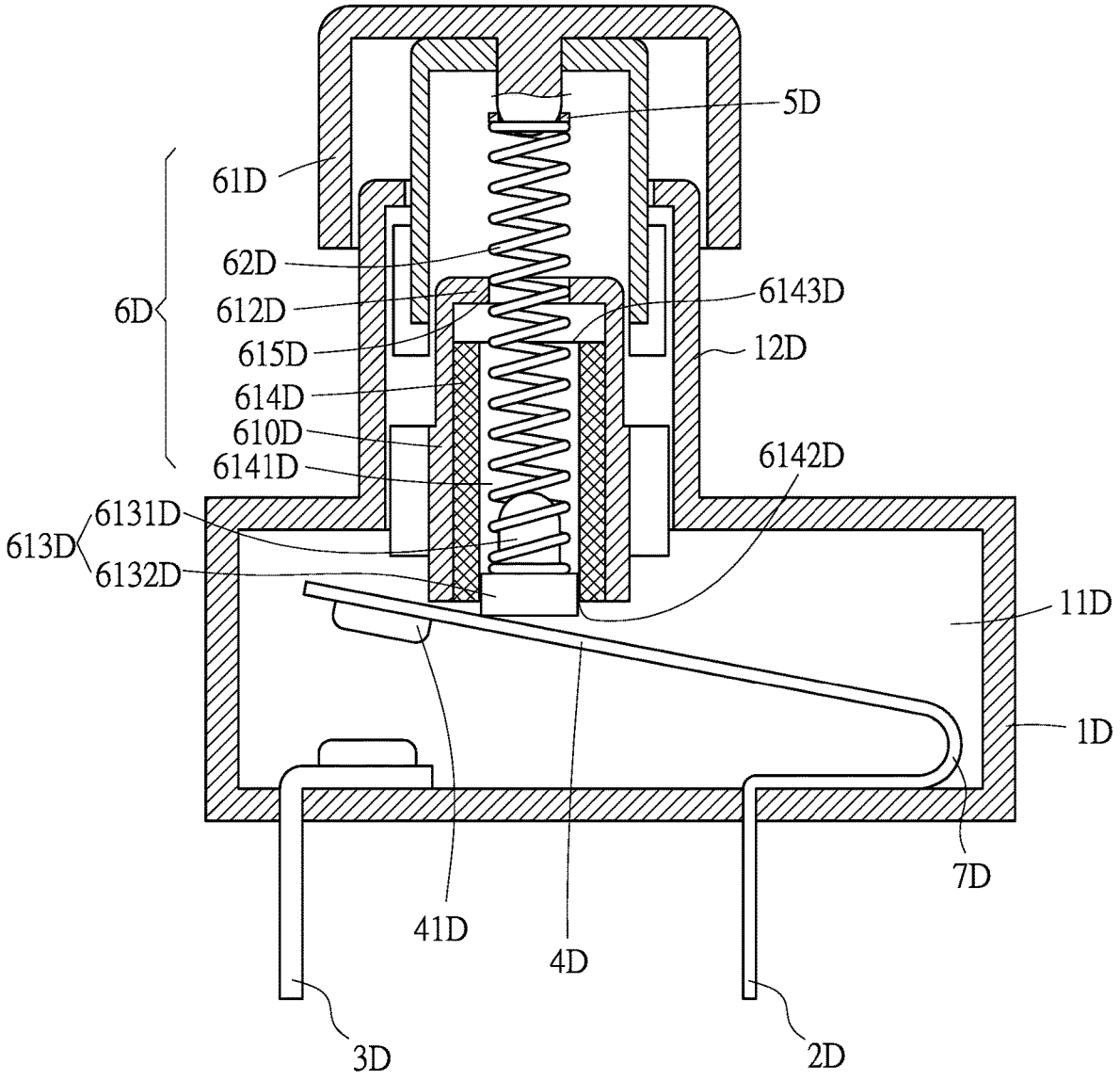
FIG. 12 is a schematic view of the fourth embodiment of the present invention, and shows, when an overheating destructive member is destructed due to overheating, a movable conductive member separated from a second conductive member to forms an open circuit.

Referring to FIG. 12, when an abnormal condition occurs in an external electric equipment connected to the first conductive member (2D) or the second conductive member (3D), for example, the external electric equipment is a plug socket, oxides or dust present between the metal pins of a plug and the plug socket, or incomplete insertion or distortion of the metal pins will produce relatively large amounts of heat energy in the electrical conducting portions of the plug socket, whereupon, the heat energy is transferred to the conductive cantilever member (4D) through the first conductive member (2D) or the second conductive member (3D), and then through the supporting base (6132D) of the supporting heat conducting member (613D), the limiting post (6131D), and the first elastic member (62D). The heat is then finally transferred to the overheating destructive member (5D), which gradually absorbs the heat energy up to the melting point thereof, at which time the overheating destructive member (5D) begins to gradually lose its rigidity. For example, if the material of the overheating destructive member (5D) is a tin-bismuth alloy, although the melting point thereof is 138° C., the tin-bismuth alloy begins to lose its rigidity when the temperature is close to its melting point, and under the concurrent effect of the first elastic force, the overheating destructive member (5D) is compressed and deformed by the first elastic member (62D) to the extent of being destructed, and, thus, no longer able to restrain the first elastic member (62D). Consequently, the first elastic member (62D) destructs the overheating destructive member (5D) and extends out through the through hole (615D), resulting in lessening or loss of the first elastic force. At which time the second elastic force is larger than the first elastic force, which forces the conductive cantilever member (4D) to restore its original position, causing the silver contact point (41D) of the conductive cantilever member (4D) to separate from the second conductive member (3D) and form a power-off state, thereby achieving the protective effect against overheating.

Figure 13:
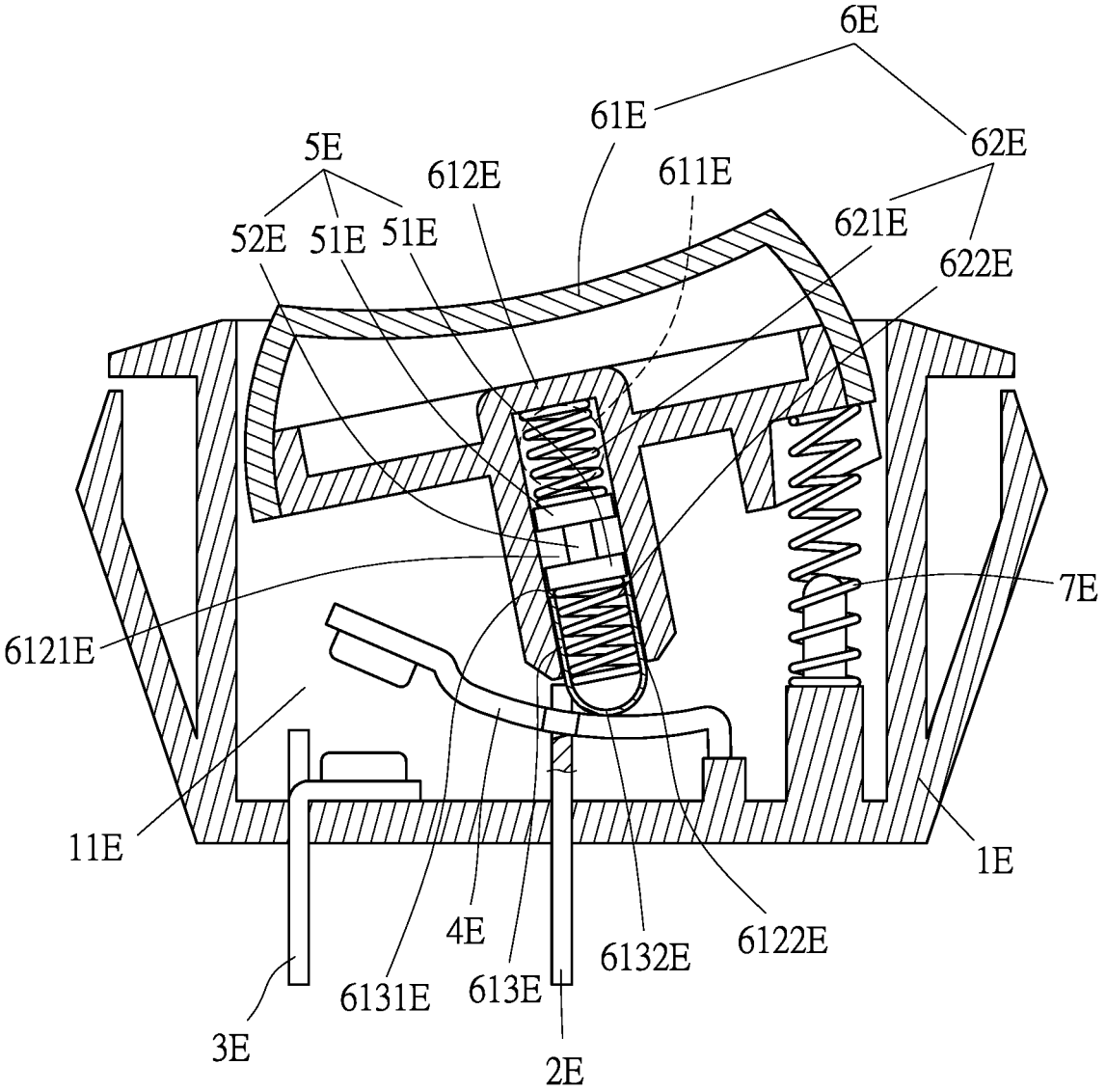
FIG. 13 is a schematic view of a fifth embodiment of the present invention, and shows a seesaw switch structure with the seesaw switch in a closed position.

Referring to FIG. 13, which shows a fifth embodiment of the present invention, wherein the heat destructive disconnecting switch of the present embodiment is a seesaw switch, and FIG. 13 depicts the seesaw switch in a closed state. The seesaw switch comprises:

A base (1E), which is provided with a holding space (11E); a first conductive member (2E) and a second conductive member (3E), both of which penetrate and are mounted on the base (1E); a movable conductive member, which is mounted within the holding space (11E), wherein the movable conductive member is a conductive seesaw member (4E), which astrides and is mounted on the first conductive member (2E) and is electrically connected to the first conductive member (2E); and an overheating destructive member (5E), which is destructed under a fail temperature condition, the fail temperature lying between 100° C. to 250° C. The overheating destructive member (5E) is not used to maintain the continued supply of electric current, hence insulating materials such as plastic or non-insulating materials made of a low-melting alloy, such as an alloy of bismuth and any one of or a composition from a plurality of the metals cadmium, indium, silver, tin, lead, antimony, or copper, or other low-melting metals or alloys with melting points lying between 100° C. to 250° C., such as a tin-bismuth alloy with a melting point around 138° C. can be used. In the present embodiment, the overheating destructive member (5E) comprises two destructive pieces (51E) and a column member (52E) connected therebetween. However, the overheating destructive member (5E) can also be a circular disk, a cylindrical body, a cap, a block, a spherical body, an irregular shaped body, or a radial shaped disk.

When there is a temperature anomaly rise in the operating temperature, it is preferred that a live wire triggers a circuit break; therefore, the first conductive member (2E) in use is a live wire first end, the second conductive member (3E) in use is a live wire second end, and the conductive seesaw member (4E) is used to enable electrical conduction with the first conductive member (2E) and the second conductive member (3E) to form a live wire closed circuit.

The seesaw switch of the present embodiment is further provided with an operating component (6E), which is used to operate the conductive seesaw member (4E) to connect with the first conductive member (2E) and the second conductive member (3E) to form a live wire closed circuit or disconnect the circuit between the first conductive member (2E) and the second conductive member (3E), causing the live wire to form an open circuit. The operating component (6E) is assembled on the base (1E) and comprises an operating member (61E) and a first elastic member (62E). The operating member (61E) is provided with a pivot connecting point (611E) that is pivot connected to the base (1E), thereby enabling the operating member (61E) to use the pivot connecting point (611E) as an axis and limit back and forth rotation. The operating member (61E) further comprises a contact member and a limiting member (612E), wherein the contact member is a hollow shaped heat conducting member (613E), which comprises an open end (6131E) and a curved contact end (6132E). The contact end (6132E) of the heat conducting member (613E) contacts the conductive seesaw member (4E), and the limiting member (612E) is provided with a hollow retaining space (6121E) that is provided with an opening (6122E). The first elastic member (62E) comprise a first spring (621E) and a second spring (622E), wherein the first spring (621E), the second spring (622E), and the overheating destructive member (5E) are disposed within the retaining space (6121E). The heat conducting member (613E) is connected to the limiting member (612E) and seals the opening (6122E), the first spring (621E) butts against the internal surface of the limiting member (612E), and the second spring (622E) extends into the heat conducting member (613E) through the open end (6131E) to butt against the heat conducting member (613E). The overheating destructive member (5E) is disposed between the first spring (621E) and the second spring (622E), and the two destructive pieces (51E) respectively butt against the first spring (621E) and the second spring (622E). The first spring (621E) and the second spring (622E) are compressed and respectively provided with an elastic force, wherein the total combined elastic force of the first spring (621E) and the second spring (622E) provides a first elastic force.

The seesaw switch of the present embodiment is further provided with a second elastic member (7E), which, in the present embodiment, is a spring. The second elastic member (7E) is provided with a second elastic force that acts on the operating member (61E).

Figure 14:
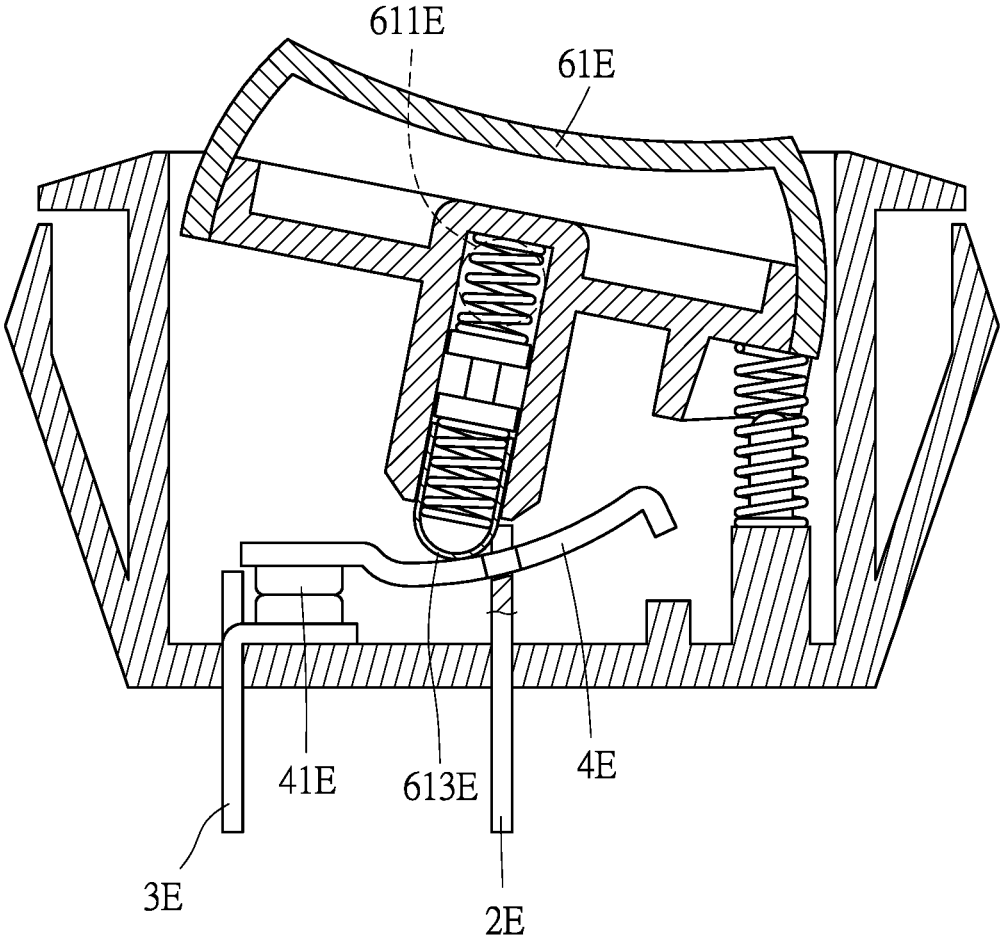
FIG. 14 is a schematic view of the fifth embodiment of the present invention, and shows the seesaw switch in an open position.

Referring to FIG. 14, a user toggles the operating member (61E) back and forth around the pivot connecting point (611E) to cause the heat conducting member (613E) to slide on the conductive seesaw member (4E) and drive the conductive seesaw member (4E) in a seesaw movement to selectively contact or separate from the second conductive member (3E). When the heat conducting member (613E) is slid on the conductive seesaw member (4E) in the direction of a silver contact point (41E) on the conductive seesaw member (4E), the first elastic force forces the silver contact point (41E) to contact the second conductive member (3E) to form a power-on state.

Figure 15:
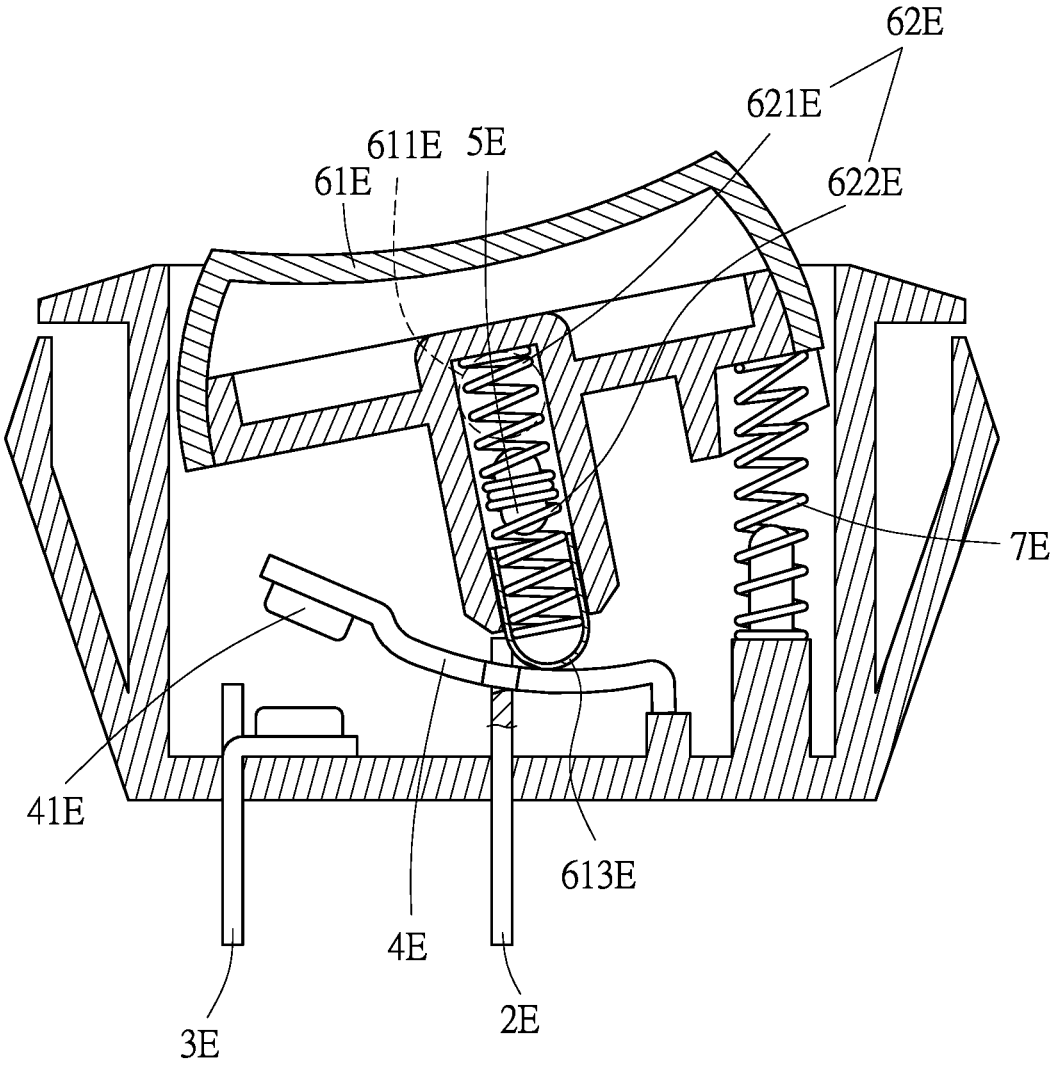
FIG. 15 is a schematic view of the fifth embodiment of the present invention, and shows, when an overheating destructive member is destructed due to overheating, a movable conductive member separated from a second conductive member, causing the seesaw switch to revert to a closed position from an open position.

Referring to FIG. 15, when an abnormal condition occurs in an external electric equipment connected to the first conductive member (2E) or the second conductive member (3E); for example, the external electric equipment is a plug socket; oxides or dust present between the metal pins of a plug and the plug socket, or phenomena such as incomplete insertion of the metal pins or distorted metal pins will produce relatively large amounts of heat energy in the electrical conducting portions of the plug socket, whereupon, the first conductive member (2E) or the second conductive member (3E) transfers the heat energy to the conductive seesaw member (4E) and then through the heat conducting member (613E) and the second spring (622E) to the overheating destructive member (5E). The overheating destructive member (5E) gradually absorbs the heat energy up to the melting point thereof and begins to gradually lose its rigidity. For example, if the material of the overheating destructive member (5E) is a tin-bismuth alloy, although the melting point thereof is 138° C., the tin-bismuth alloy begins to lose its rigidity when the temperature is close to its melting point, and under the concurrent effect of the first elastic force, the overheating destructive member (5E) is compressed and deformed by the first spring (621E) and the second spring (622E) to the extent of being destructed. In the present embodiment, the overheating destructive member (5E) shown in FIG. 13, having been destructed, becomes the state shown in FIG. 15, which causes both the first spring (621E) and the second spring (622E) to elongate, resulting in lessening or loss of the first elastic force, at which time the second elastic force is larger than that of the first elastic force. In the present embodiment, the arrangement of the first conductive member (2E) and the second conductive member (3E) is defined as being in a lengthwise direction. The operating member (61E) has a length in the lengthwise direction, and the first elastic member (62E) is disposed at the central position of the length. Moreover, there is a distance between the disposed position of the second elastic member (7E) and the central position, hence, when the second elastic force is larger than the first elastic force, a torque effect forces the operating member (61E) to rotate on the pivot connecting point (611E) as an axis, which causes the heat conducting member (613E) to slide on the conductive seesaw member (4E), thereby forcing the operating member (61E) to displace and form a closed position. Accordingly, the silver contact point (41E) of the conductive seesaw member (4E) separates from the second conductive member (3E) to form a power-off state, thereby achieving the protective effect against overheating.

Figure 16:
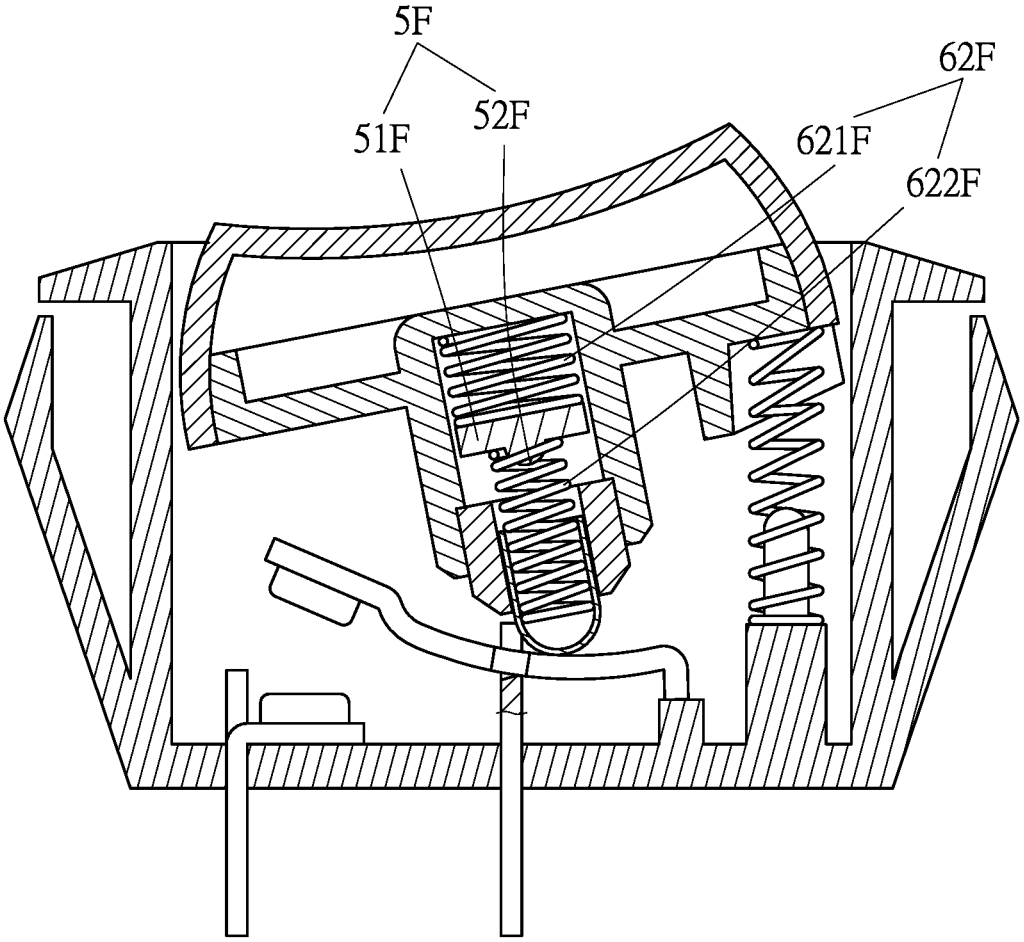
FIG. 16 is a schematic view of a sixth embodiment of the present invention, and shows another seesaw switch structure with the seesaw switch in a closed position.

Referring to FIG. 16, which shows a sixth embodiment of the present invention, wherein the heat destructive disconnecting switch of the present embodiment is a seesaw switch, and FIG. 16 depicts the seesaw switch in a closed state. The present embodiment is almost the same as the fifth embodiment, the only differences being in:

The present embodiment is provided with an overheating destructive member (5F) and one first elastic member (62F), wherein the overheating destructive member (5F) comprises a destructive piece (51F) and a protruding portion (52F). The first elastic member (62F) comprise a first spring (621F) and a second spring (622F), wherein the width of the first spring (621F) is larger than that of the second spring (622F), and the overheating destructive member (5F) is disposed between the first spring (621F) and the second spring (622F). The two corresponding sides of the destructive piece (51F) respectively butt against the first spring (621F) and the second spring (622F), and the protruding portion (52F) extends into the second spring (622F) and is used to limit the second spring (622F).

Figure 17:
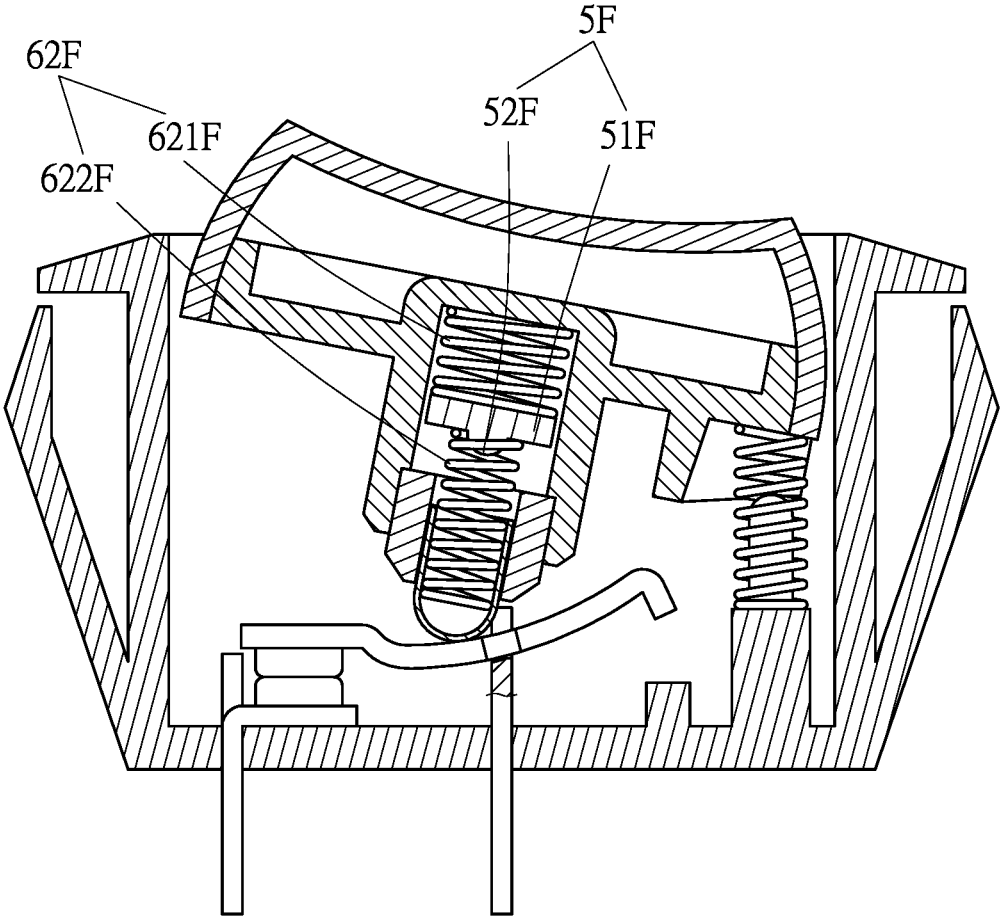
FIG. 17 is a schematic view of the sixth embodiment of the present invention, and shows the seesaw switch in an open position.

Referring to FIG. 17, which shows a live wire conducting state of the present embodiment identical to that of the fifth embodiment, and thus not further detailed herein.

Figure 18:
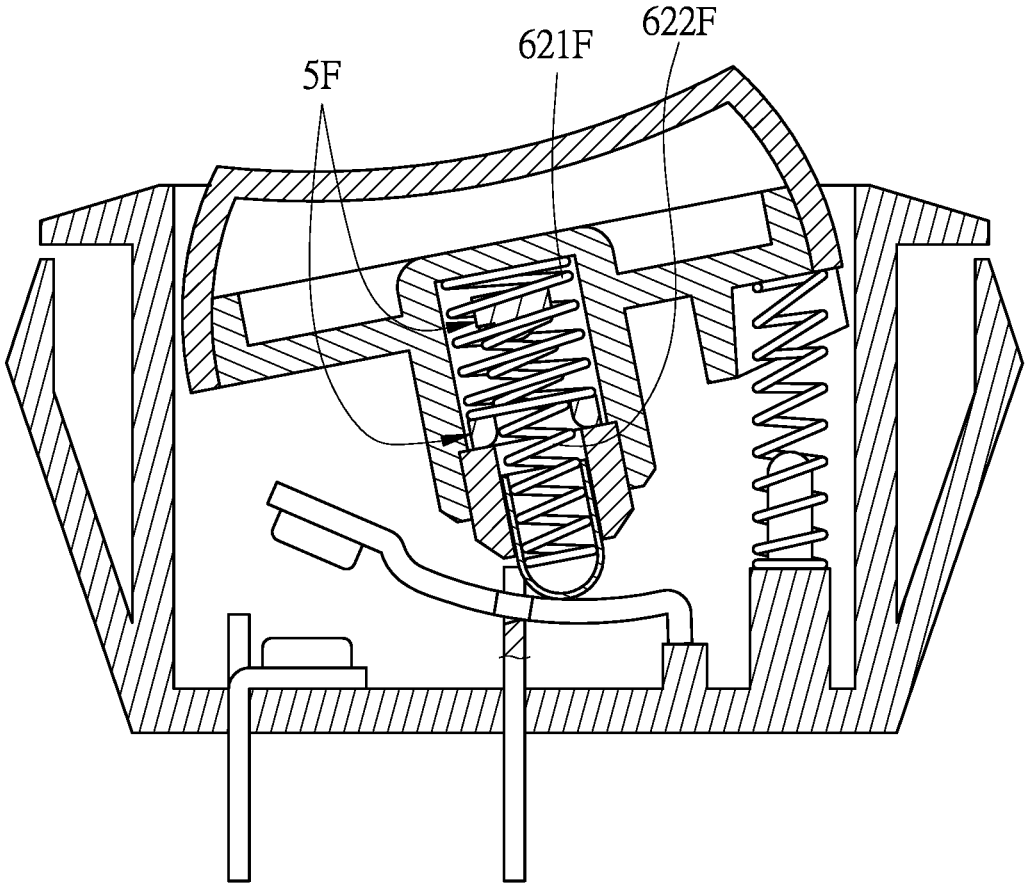
FIG. 18 is a schematic view of the sixth embodiment of the present invention, and shows, when an overheating destructive member is destructed due to overheating, a movable conductive member separated from a second conductive member, causing the seesaw switch to revert to a closed position from an open position.

Referring to FIG. 18, which shows the overheating destructive member (5F) of the present embodiment destructed due to live wire overheating. In the present embodiment. the overheating destructive member (5F) shown in FIG. 16, having been destructed, becomes the state shown in FIG. 18, which has caused both the first spring (621F) and the second spring (622F) to elongate. Whereupon, the first spring (621F) and the second spring (622F) release their elastic force in opposite directions, causing the second spring (622F) to penetrate into the first spring (621F), and form a power-off state.

Figure 19:
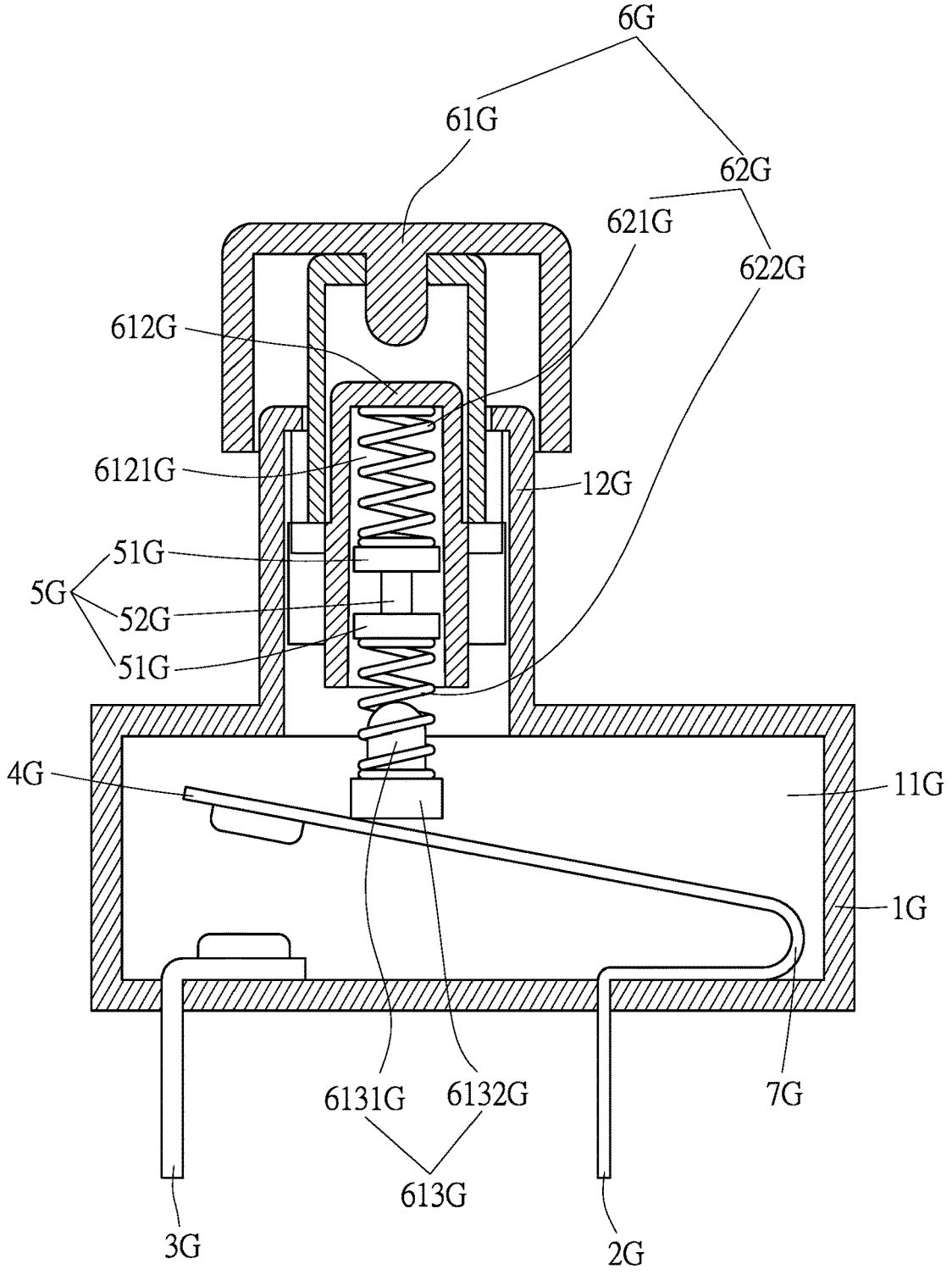
FIG. 19 is a schematic view of a seventh embodiment of the present invention, and shows a press switch structure with the press switch in a closed position.

Referring to FIG. 19, which shows a seventh embodiment of the present invention, wherein the heat destructive disconnecting switch of the present embodiment is a press switch, and FIG. 19 depicts the press switch in a closed state. The press switch comprises:

A base (1G), which is provided with a holding space (11G) and a protruding portion (12G); a first conductive member (2G) and a second conductive member (3G), both of which penetrate and are mounted on the base (1G); a movable conductive member, which is mounted within the holding space (11G), wherein the movable conductive member is a conductive cantilever member (4G); and an overheating destructive member (5G), which is destructed under a fail temperature condition, the fail temperature lying between 100° C. to 250° C. The overheating destructive member (5G) is not used to maintain the continued supply of electric current, hence insulating materials such as plastic or non-insulating materials made of a low-melting alloy, such as an alloy of bismuth and any one of or a composition from a plurality of the metals cadmium, indium, silver, tin, lead, antimony, or copper, or other low-melting metals or alloys with melting points lying between 100° C. to 250° C., such as a tin-bismuth alloy with a melting point around 138° C. can be used. In the present embodiment, the overheating destructive member (5G) comprises two destructive pieces (51G) and a column member (52G) connected between the two destructive pieces (51G). However, the overheating destructive member (5G) can also be a circular disk, cylindrical body, a cap, a block, a spherical body, an irregular shaped body, or a radial shaped disk.

When there is a temperature anomaly rise in the operating temperature, it is preferred that a live wire triggers a circuit break; thus, the first conductive member (2G) in use is a live wire first end, and the second conductive member (3G) in use is a live wire second end, and the conductive cantilever member (4G) is used to conduct current to the first conductive member (2G) and the second conductive member (3G) and form a live wire closed circuit.

The press switch of the present embodiment is further provided with an operating component (6G), which is used to operate the conductive cantilever member (4G) to connect with the first conductive member (2G) and the second conductive member (3G) to form a live wire closed circuit or disconnect the circuit between the first conductive member (2G) and the second conductive member (3G), causing the live wire to form an open circuit. The operating component (6G) is assembled on the base (1G) and comprises an operating member (61G) and a first elastic member (62G). The operating member (61G) is mounted on the protruding portion (12G) and has limited up and down displacement thereon. The up and down displacement and positioning structure of the entire operating component (6G) is the same as the press button structure of an automatic ball-point pen of the prior art, such as the prior art structure of a "Push-button Switch" disclosed in China Patent No. CN103441019; therefore, the drawings of the present embodiment omit illustrating a number of structural positions disclosed in the prior art. The operating member (61G) further comprises a contact member and a limiting member (612G), and the limiting member (612G) is provided with a hollow retaining space (6121G). The first elastic member (62G) comprises a first spring (621G) and a second spring (622G), wherein the first spring (621G), the second spring (622G), and the overheating destructive member (5G) are disposed within the retaining space (6121G), and the first spring (621G) butts against the internal surface of the limiting member (612G). The contact member is a supporting heat conducting member (613G), which is provided with a limiting post (6131G) and a supporting base (6132G). The limiting post (6131G) extends into the second spring (622G), which causes the second spring (622G) to butt against the supporting base (6132G), thereby enabling the supporting base (6132G) to contact the conductive cantilever member (4G). The overheating destructive member (5G) is disposed between the first spring (621G) and the second spring (622G), which causes the two destructive pieces (51G) to respectively butt against the first spring (621G) and the second spring (622G). The first spring (621G) and the second spring (622G) are thereby compressed and respectively provided with an elastic force. The total combined elastic force of the first spring (621G) and the second spring (622G) provides a first elastic force.

The press switch of the present embodiment is further provided with a second elastic member, which is a spring plate (7G), wherein the first conductive member (2G), the spring plate (7G), and the conductive cantilever member (4G) are formed as an integral body. The spring plate (7G) is provided with a second elastic force that indirectly acts on the operating member (61G).

Figure 20:
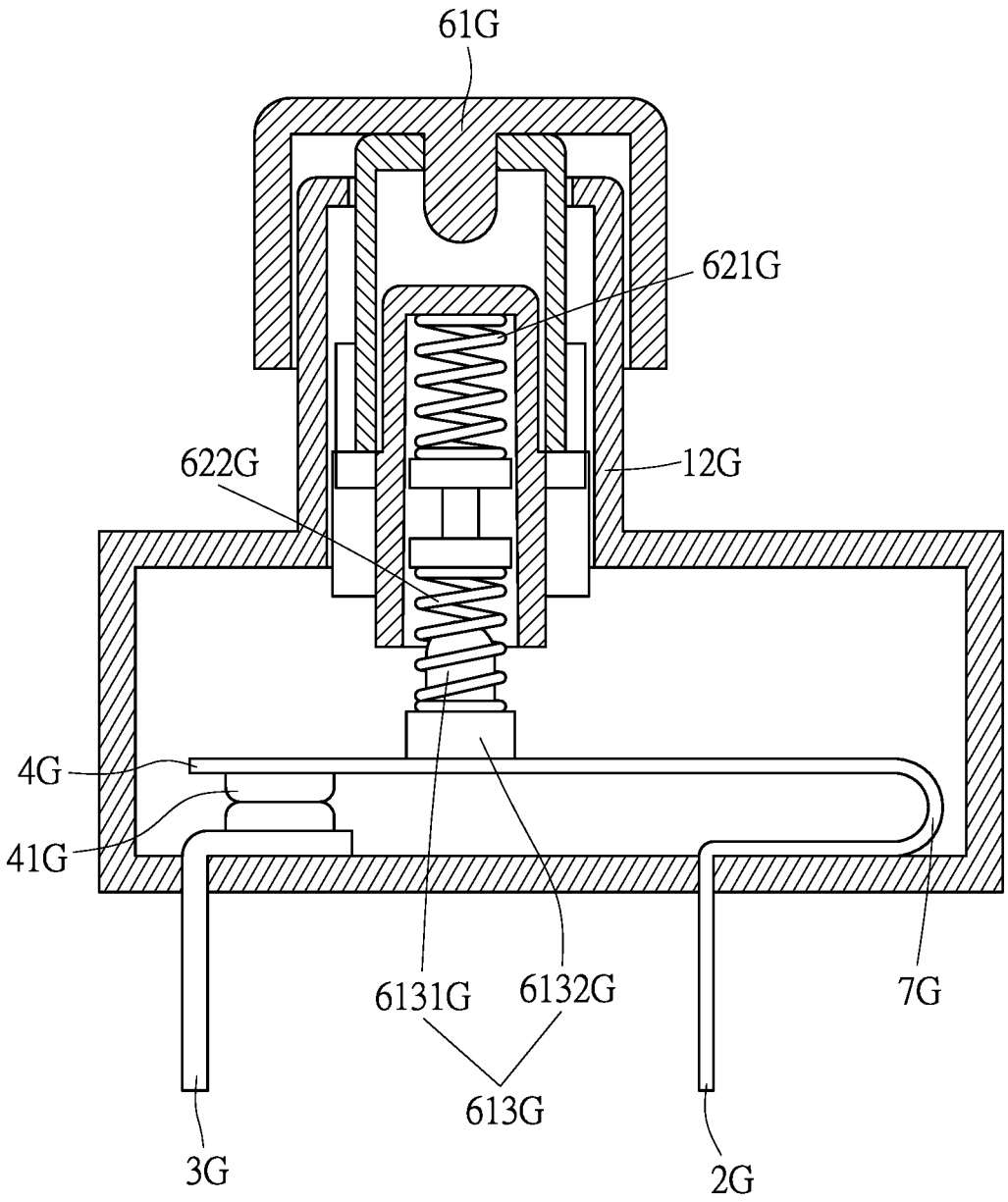
FIG. 20 is a schematic view of the seventh embodiment of the present invention, and shows the press switch in an open position.

Referring to FIG. 20, a user displaces the operating member (61G) relative to the protruding portion (12G), just like pressing the button on an automatic ball-point pen, which causes the conductive cantilever member (4G) to selectively contact or separate from the second conductive member (3G). When the operating member (61G) is displaced in the direction of the conductive cantilever member (4G) and positioned, the supporting base (6132G) of the supporting heat conducting member (613G) presses a silver contact point (41G) of the conductive cantilever member (4G), which causes the conductive cantilever member (4G) to contact the second conductive member (3G) and form a power-on state, at the same time the first spring (621G) and the second spring (622G) are further compressed, thereby enlarging the first elastic force.

Figure 21:
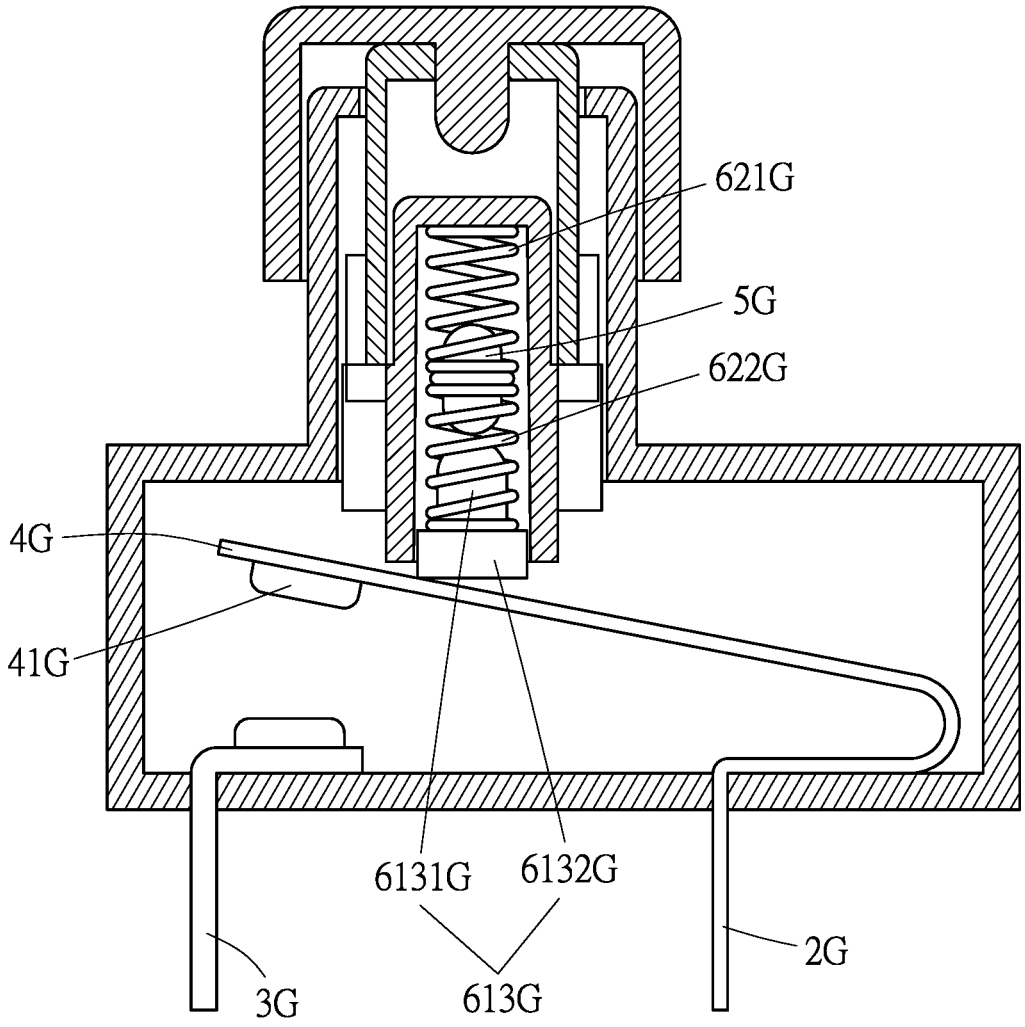
FIG. 21 is a schematic view of the seventh embodiment of the present invention, and shows, when an overheating destructive member is destructed due to overheating, a movable conductive member separated from a second conductive member to form an open circuit.

Referring to FIG. 21, when an abnormal condition occurs in an external electric equipment connected to the first conductive member (2G) or the second conductive member (3G); for example, the external electric equipment is a plug socket; oxides or dust present between the metal pins of a plug and the plug socket, or incomplete insertion or distortion of the metal pins will produce relatively large amounts of heat energy in the electrical conducting portions of the plug socket, whereupon, the heat energy is transferred to the conductive cantilever member (4G) through the first conductive member (2G) or the second conductive member (3G), and then through the supporting base (6132G) of the supporting heat conducting member (613G), the limiting post (6131G), and the second spring (622G) to the overheating destructive member (5G). The overheating destructive member (5G) gradually absorbs the heat energy up to the melting point thereof; at which time the overheating destructive member (5G) begins to gradually lose its rigidity. For example, if the material of the overheating destructive member (5G) is a tin-bismuth alloy, although the melting point thereof is 138° C., the tin-bismuth alloy begins to lose its rigidity when the temperature is close to its melting point, and under the concurrent effect of the first elastic force, the overheating destructive member (5G) is compressed and deformed by the first spring (621G) and the second spring (622G). In the present embodiment, the overheating destructive member (5G) shown in FIG. 19, having been destructed, becomes the shape shown in FIG. 21, which causes both the first spring (621G) and the second spring (622G) to elongate, resulting in lessening or loss of the first elastic force. At which time the second elastic force is larger than the first elastic force, forcing the conductive cantilever member (4G) to restore its original position, which causes the silver contact point (41G) of the conductive cantilever member (4G) to separate from the second conductive member (3G) to form a power-off state, thereby achieving the protective effect against overheating.

Figure 22:
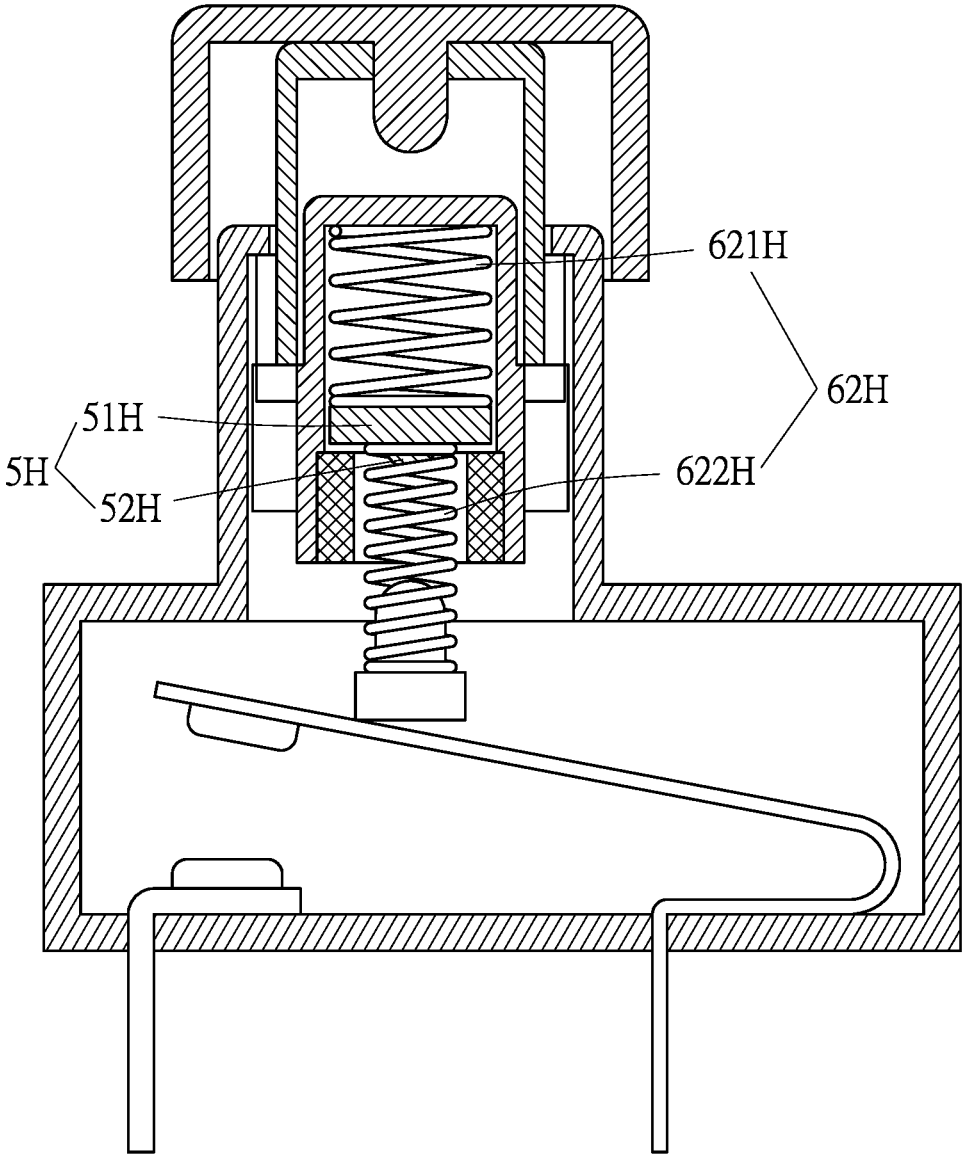
FIG. 22 is a schematic view of an eighth embodiment of the present invention, and shows another press switch structure with the press switch in a closed position.

Referring to FIG. 22, which shows an eighth embodiment of the present invention, wherein the heat destructive disconnecting switch of the present embodiment is a press switch, and FIG. 22 depicts the press switch in a closed state. The present embodiment is almost the same as the third embodiment, the only differences being in:

The present embodiment is provided with an overheating destructive member (5H) and one first elastic member (62H). The overheating destructive member (5F) comprises a destructive piece (51H) and a protruding portion (52H). The first elastic member (62H) comprises a first spring (621H) and a second spring (622H), wherein the width of the first spring (621H) is larger than that of the second spring (622H). The overheating destructive member (5H) is disposed between the first spring (621H) and the second spring (622H), which causes the two corresponding sides of the destructive piece (51H) to respectively butt against the first spring (621H) and the second spring (622H), with the protruding portion (52H) extending into the second spring (622H) and used to limit the second spring (622H).

Figure 23:
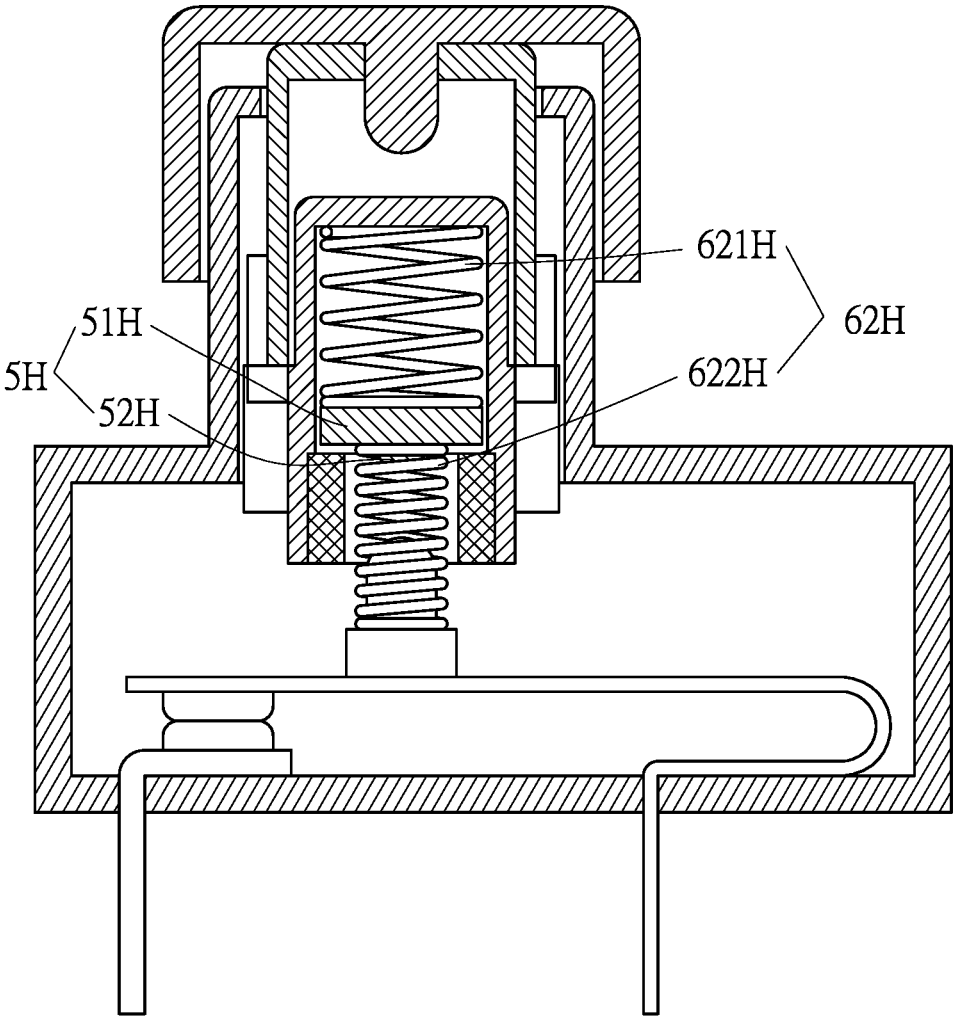
FIG. 23 is a schematic view of the eighth embodiment of the present invention, and shows the press switch in an open position.

Referring to FIG. 23, which shows a live wire conducting state of the present embodiment identical to that of the seventh embodiment, and thus not further detailed herein.

Figure 24:
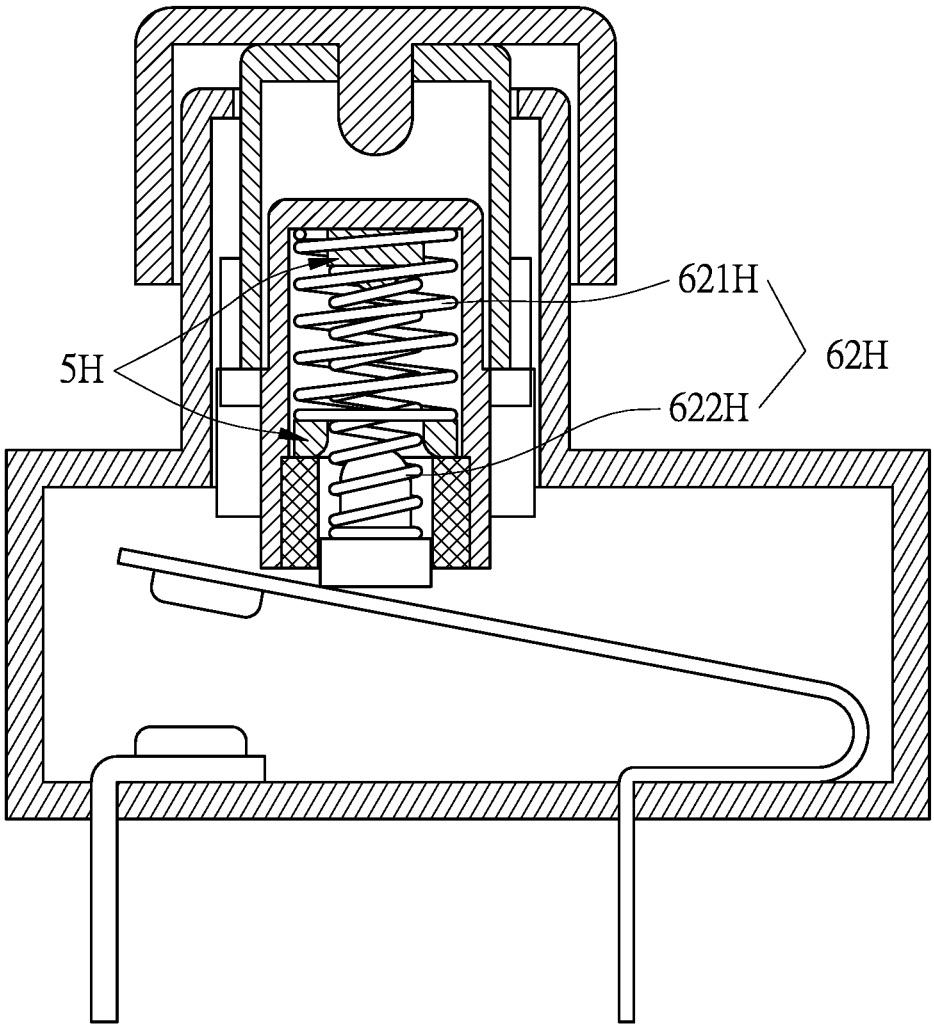
FIG. 24 is a schematic view of the eighth embodiment of the present invention, and shows, when an overheating destructive member is destructed because of overheating, a movable conductive member separated from a second conductive member to form an open circuit.
Figure 25:
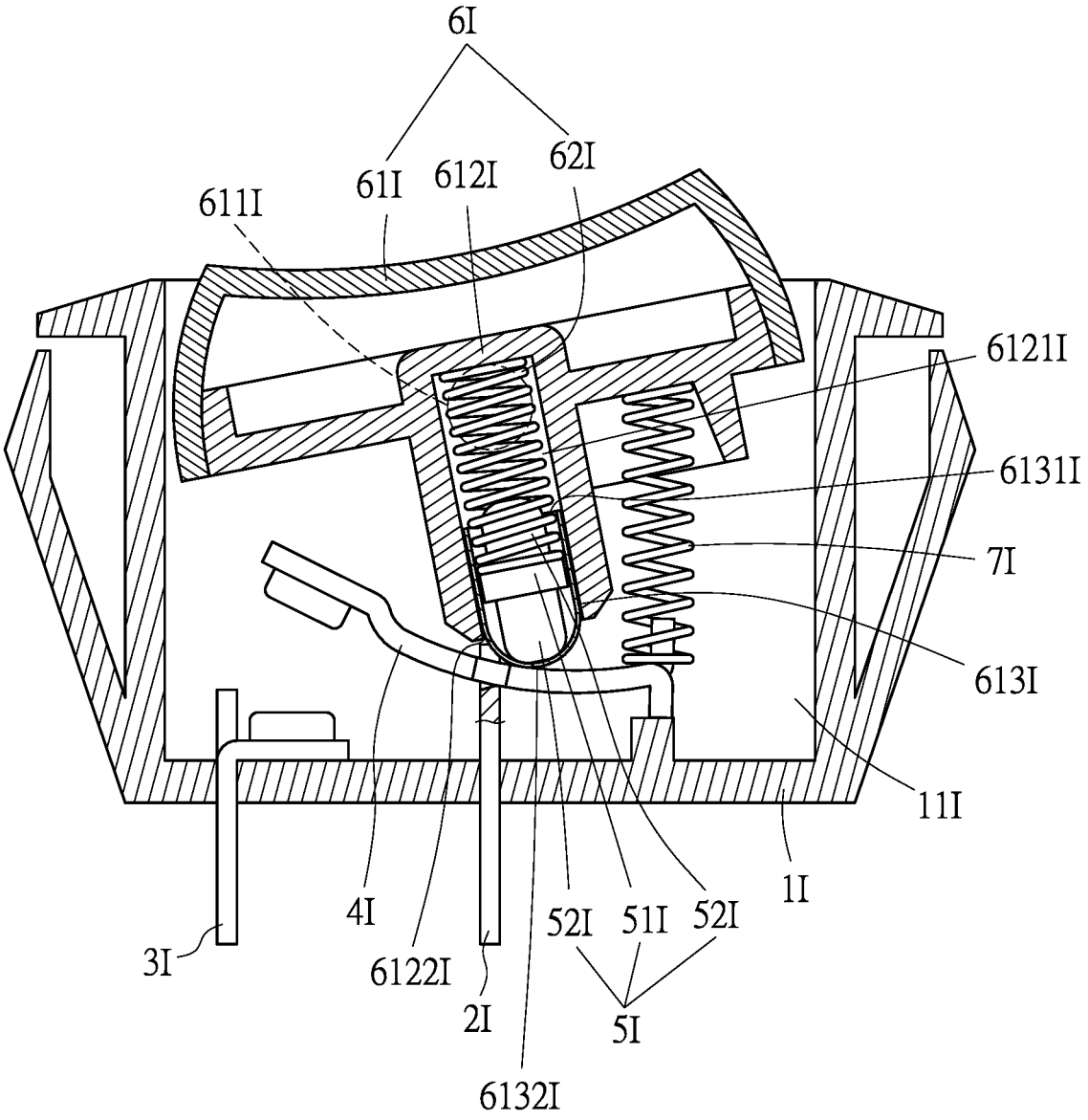
FIG. 25 is a schematic view of a ninth embodiment of the present invention, and shows a seesaw switch structure with the seesaw switch in a closed position.

Referring to FIG. 24, which shows the overheating destructive member (5H) of the present embodiment destructed due to live wire overheating. In the present embodiment, the overheating destructive member shown in FIG. 22, having been destructed, becomes the state shown in FIG. 24, which has caused both the first spring (621H) and the second spring (622H) to elongate. Consequently, the first spring (621H) and the second spring (622H) release their elastic force in opposite directions, causing the second spring (622H) to penetrate into the first spring (621H), Referring to FIG. 25, which shows a ninth embodiment of the present invention, wherein the heat destructive disconnecting switch of the present embodiment is a seesaw switch, and FIG. 25 depicts the seesaw switch in a closed state. The seesaw switch comprises:

A base (1I), which is provided with a holding space (11I); a first conductive member (2I) and a second conductive member (3I), both of which penetrate and are mounted on the base (1I); a movable conductive member, which is mounted within the holding space (11I), wherein the movable conductive member is a conductive seesaw member (4I) that astrides and is mounted on the first conductive member (2I) and electrically connected to the first conductive member (2I); and an overheating destructive member (5I), which is destructed under a fail temperature condition, the fail temperature lying between 100° C. to 250° C. The overheating destructive member (5I) is not used to maintain the continued supply of electric current; therefore, insulating material such as plastic or non-insulating material made of a low-melting alloy, or low-melting metals can be used. The aforementioned low-melting alloys include an alloy of bismuth and any one of or a composition from a plurality of the metals cadmium, indium, silver, tin, lead, antimony, or copper, among which a tin-bismuth alloy has a melting point around 138° C. In the present embodiment, the overheating destructive member (5I) comprises a destructive portion (51I) and two protruding portions (52I), and the two protruding portions (52I) are located on corresponding surfaces of the destructive portion (51I). However, the overheating destructive member (5I) can also be a circular disk, a cylindrical body, a cap, a block, a spherical body, an irregular shaped body, or a radial shaped disk.

When there is a temperature anomaly rise in the operating temperature, it is preferred that a live wire triggers a circuit break. Therefore, the first conductive member (2I) in use is a live wire first end, the second conductive member (3I) in use is a live wire second end, and the conductive seesaw member (4I) is used to enable electrical conduction with the first conductive member (2I) and the second conductive member (3I) to form a live wire closed circuit.

The seesaw switch of the present embodiment is further provided with an operating component (6I), which is used to operate the conductive seesaw member (4I) to connect with the first conductive member (2I) and the second conductive member (3I) to form a live wire closed circuit or disconnect the circuit between the first conductive member (2I) and the second conductive member (3I), causing the live wire to form an open circuit. The operating component (6I) is assembled on the base (1I) and comprises an operating member (61I) and a first elastic member (62I), wherein a press surface of the operating member (61I) is a nonconductor. The operating member (61I) is provided with a pivot connecting point (611I), which is pivot connected to the base (1I), thereby enabling the operating member (61I) to use the pivot connecting point (611I) as an axis and limit back and forth rotation. The operating member (61I) further comprises a contact member and a limiting member (612I), wherein the contact member is a hollow shaped heat conducting member (613I), which comprises an open end (6131I) and a curved contact end (6132I). The contact end (6132I) of the heat conducting member (613I) contacts the conductive seesaw member (4I), and the limiting member (612I) is provided with a hollow retaining space (6121I), which is provided with an opening (6122I). The first elastic member (62I) is inserted within the retaining space (6121I), and the heat conducting member (613I) partially penetrates into the opening (6122I). The overheating destructive member (5I) is disposed within the heat conducting member (613I) through the open end (6131I), causing one of the protruding portions (52I) to but against the heat conducting member (613I), and enabling the destructive portion (51I) to contact the heat conducting member (613I). The other protruding portion (52I) extends into the first elastic member (62I), causing one end of the first elastic member (62I) to butt against the internal surface of the limiting member (612I), and the other end of the first elastic member (62I) to butt against the destructive portion (51I) of the overheating destructive member (5I). As a result, the first elastic member (62I) is compressed and provided with a first elastic force.

The seesaw switch of the present embodiment is further provided with a second elastic member (7I), which, in the present embodiment, is a spring. The second elastic member (7I) is provided with a second elastic force that acts on the operating member (61I).

Figure 26:
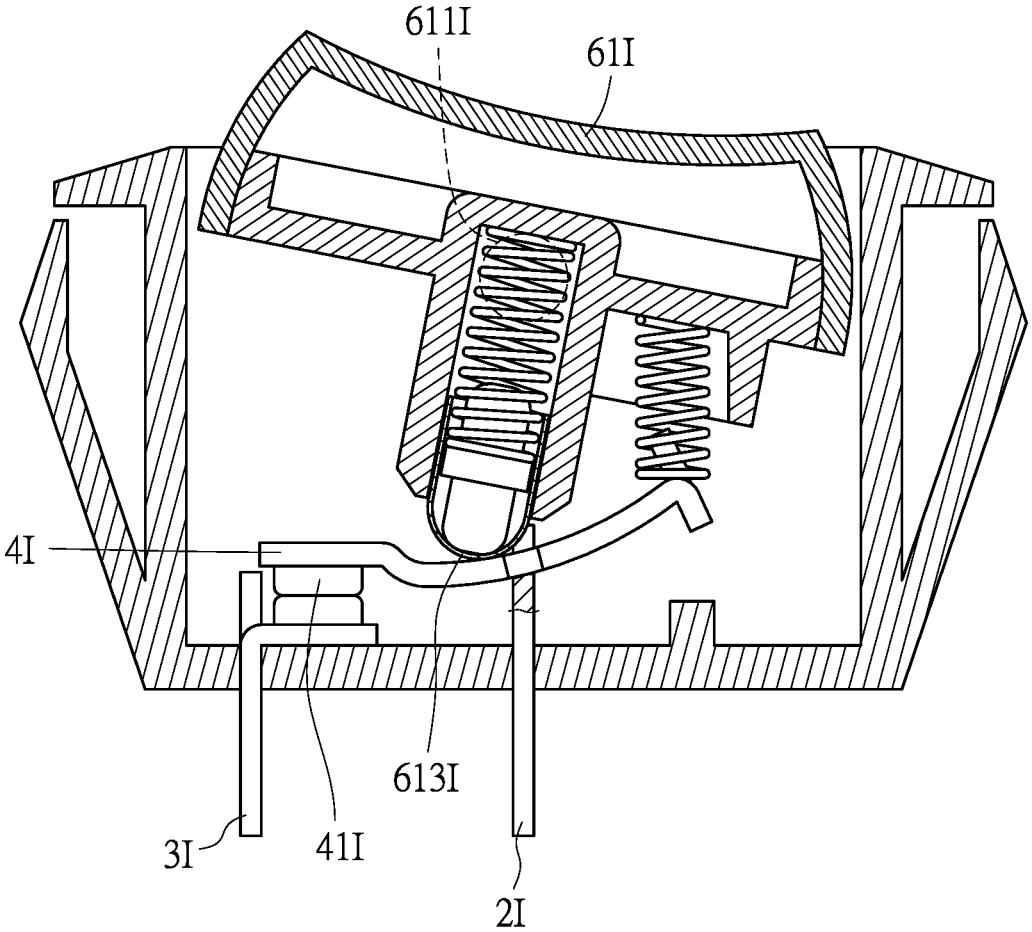
FIG. 26 is a schematic view of the ninth embodiment of the present invention, and shows the seesaw switch in an open position.

Referring to FIG. 26, a user toggles the operating member (61I) back and forth around the pivot connecting point (611I), causing the heat conducting member (613I) to slide on the conductive seesaw member (4I), which forces the conductive seesaw member (4I) to selectively contact or separate from the second conductive member (3I) in a seesaw movement. When the heat conducting member (613I) is slid on the conductive seesaw member (4I) in the direction of a silver contact point (41I) on the conductive seesaw member (4I), the first elastic force forces the silver contact point (41I) to contact the second conductive member (3I) and form a power-on state.

Figure 27:
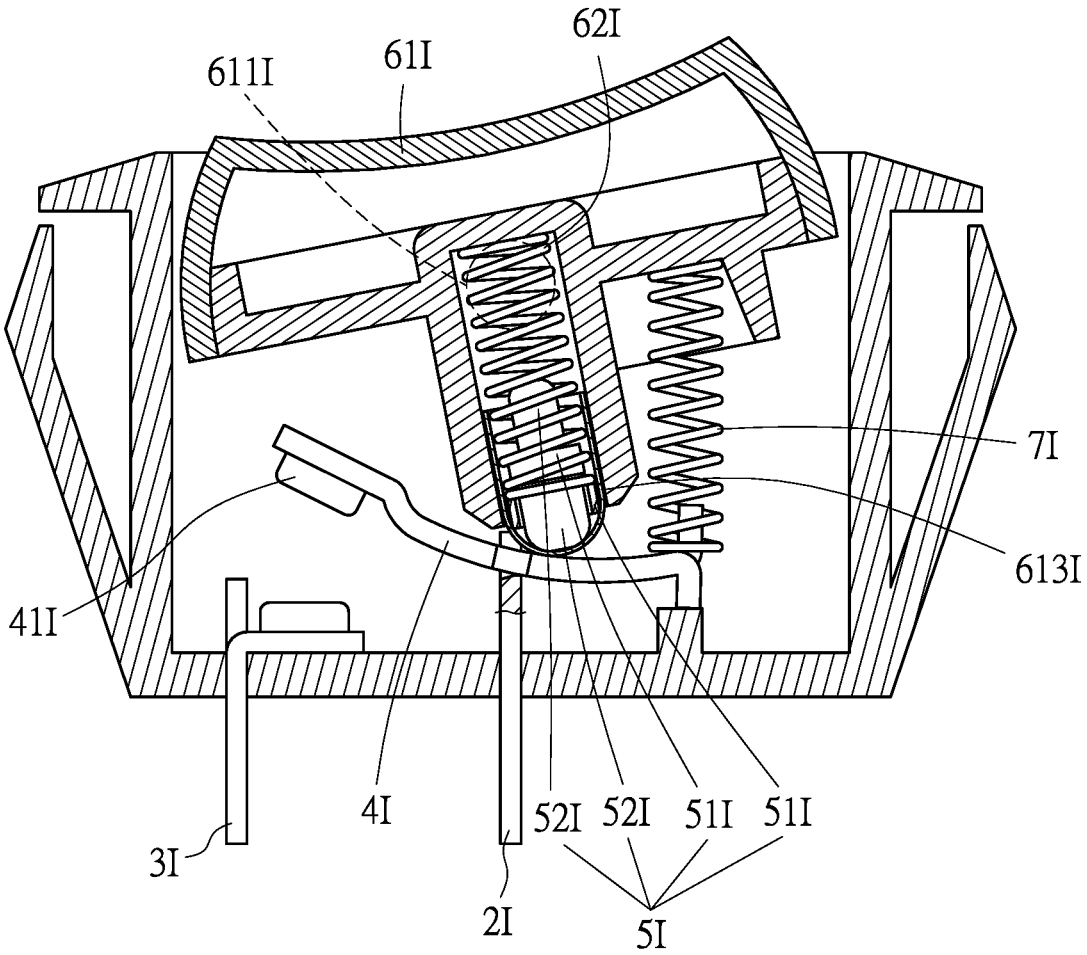
FIG. 27 is a schematic view of the ninth embodiment of the present invention, and shows, when an overheating destructive member is destructed due to overheating, a movable conductive member separated from a second conductive member, causing the seesaw switch to revert to a closed position from an open position.

Referring to FIG. 27, when an abnormal condition occurs in an external electric equipment connected to the first conductive member (2I) or the second conductive member (3I), for example, the external electric equipment is a plug socket, oxides or dust present between the metal pins of a plug and the plug socket, or phenomena such as incomplete insertion of the metal pins or distorted metal pins will cause a relatively large heat energy in the electrical conducting portions of the plug socket, whereupon, the first conductive member (2I) or the second conductive member (3I) transfers the heat energy to the conductive seesaw member (4I), and then through the heat conducting member (613I) to the destructive portion (51I) of the overheating destructive member (5I). The destructive portion (51I) gradually absorbs the heat energy up to a point prior to the melting point thereof, at which time the overheating destructive member (5I) gradually loses its rigidity. For example, if the material of the overheating destructive member (5I) is a tin-bismuth alloy, although the melting point thereof is 138° C., the tin-bismuth alloy begins lose its rigidity when the temperature is close to its melting point, and under the concurrent effect of the first elastic force, the first elastic member (62I) compresses and deforms the destructive portion (51I) of the overheating destructive member (5I) to the extent of destructing the destructive portion (51I). In the present embodiment, the destructive portion (51I) shown in FIG. 25, having been destructed into two portions, becomes the state shown in FIG. 27, which has caused the first elastic member (62I) to elongate, resulting in lessening or loss of the first elastic force, at which time the second elastic force is larger than the first elastic force. In the present embodiment, the arrangement of the first conductive member (2I) and the second conductive member (3I) is defined as being in a lengthwise direction. The operating member (61I) has a length in the lengthwise direction, and the first elastic member (62I) is disposed at the central position of the length. There is a distance between the disposed position of the second elastic member (7I) and the central position. Hence, when the second elastic force is larger than the first elastic force, a torque effect forces the operating member (61I) to rotate on the pivot connecting point (611I) as an axis, which causes the heat conducting member (613I) to slide on the conductive seesaw member (4I) and forces the operating member (61I) to displace and form a closed position. Consequently, the silver contact point (41I) of the conductive seesaw member (4I) separates from the second conductive member (3I) to form a power-off state, thereby achieving the protective effect against overheating.

Figure 28:
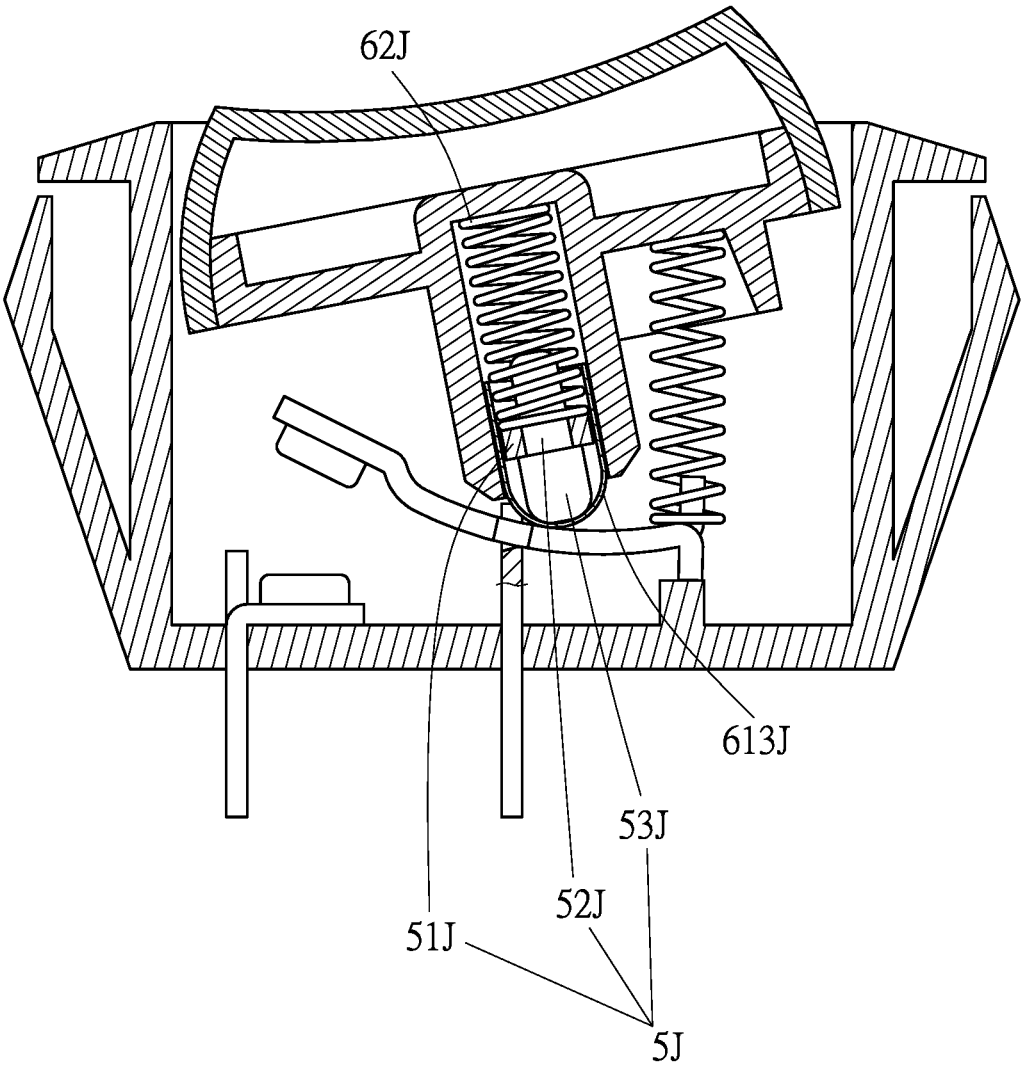
FIG. 28 is a schematic view of a tenth embodiment of the present invention, and shows another seesaw switch structure with the seesaw switch in a closed position.

Referring to FIG. 28, which shows a tenth embodiment of the present invention, wherein the heat destructive disconnecting switch of the present embodiment is a seesaw switch, and FIG. 28 depicts the seesaw switch in a closed state. The present embodiment is almost the same as the ninth embodiment, the only differences being in:

The present embodiment is provided with an overheating destructive member (5J), a first elastic member (62J), and a contact member which is a heat conducting member (613J). The overheating destructive member (5J) comprises a supporting member (51J) with a rod portion (52J) and a head portion (53J) connected thereto. The supporting member (51J) is mounted on the rod portion (52J) and contacts the heat conducting member (613J). The width of the head portion (53J) is larger than the width of the rod portion (52J), which penetrates the supporting member (51J) and extends into the first elastic member (62J), thereby causing the supporting member (51J) to restrain the head portion (53J). The head portion (53J) additionally butts against the heat conducting member (613J), and the first elastic member (62J) butts against the top surface of the supporting member (51J).

Figure 29:
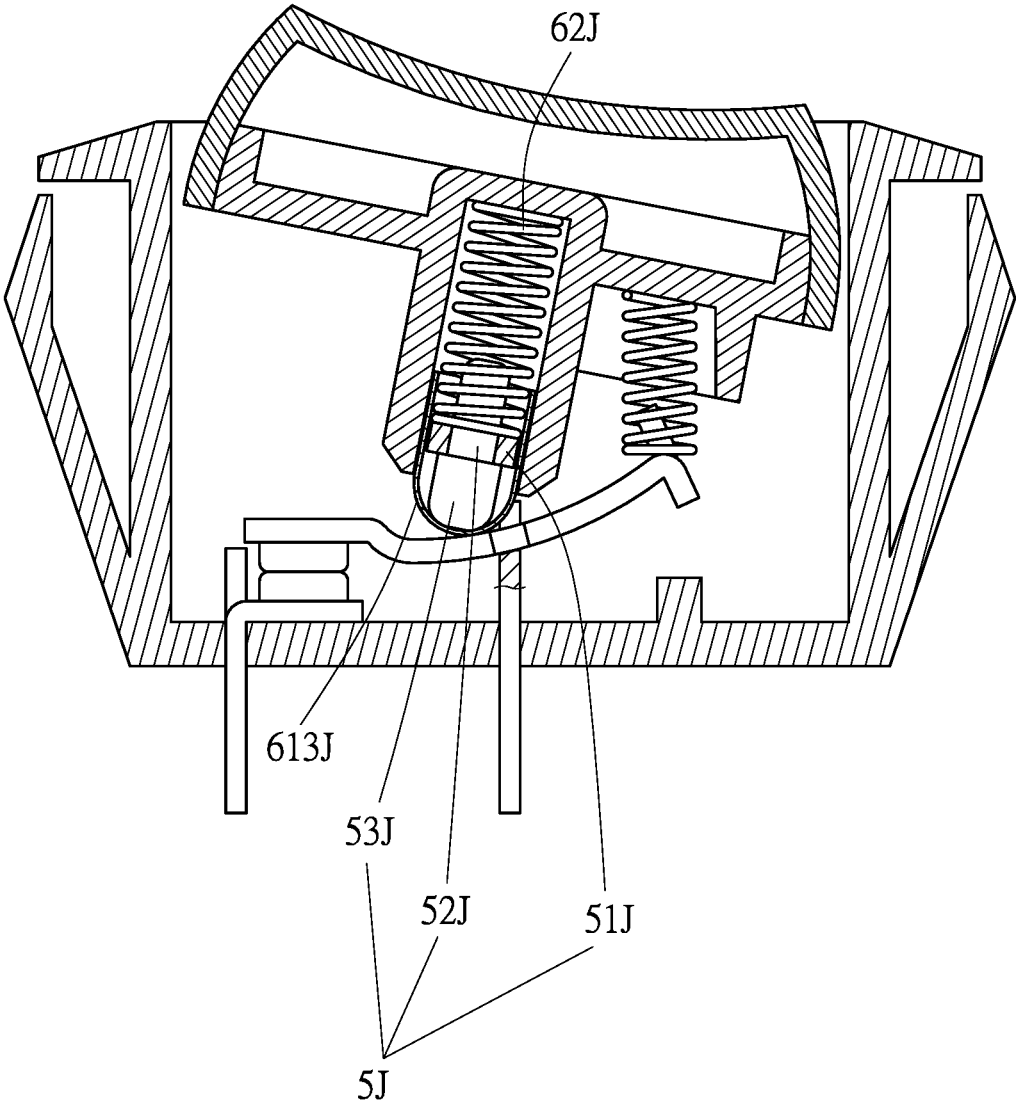
FIG. 29 is a schematic view of the tenth embodiment of the present invention, and shows the seesaw switch in an open position.

Referring to FIG. 29, which shows a live wire conducting state of the present embodiment identical to that of the ninth embodiment, and thus not further detailed herein.

Figure 30:
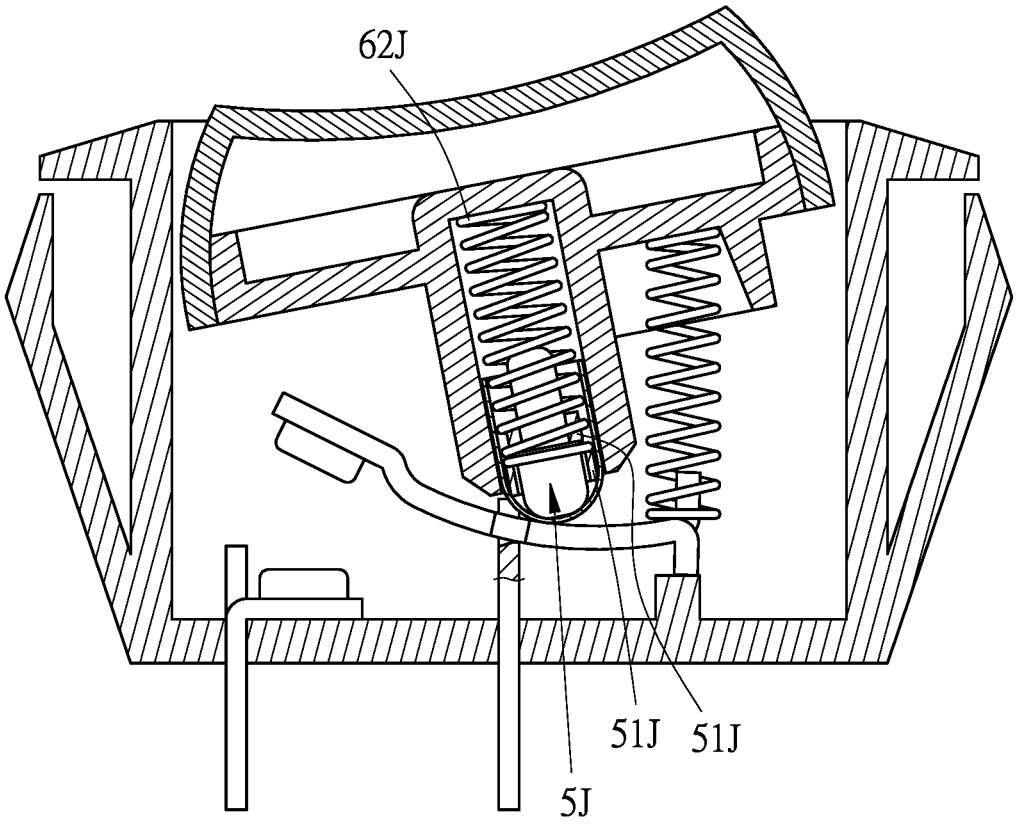
FIG. 30 is a schematic view of the tenth embodiment of the present invention, and shows, when an overheating destructive member is destructed due to overheating, a movable conductive member separated from a second conductive member, causing the seesaw switch to revert to a closed position from an open position.

Referring to FIG. 30, which shows the supporting member (51J) of the overheating destructive member (5J) of the present embodiment, due to live wire overheating and under the concurrent effect of the first elastic force, having been compressed and deformed by the first elastic member (62J) to the extent that the first elastic member (62J) has broken through the supporting member (51J). In the present embodiment, the supporting member (51J) shown in FIG. 28, having been destructed into two portions, becomes the state shown in FIG. 30, which has caused the first elastic member (62J) to elongate, resulting in lessening or loss of the first elastic force. At which time the second elastic force is larger than the first elastic force, which causes a power-off state to form similar to the first embodiment.

Figure 31:
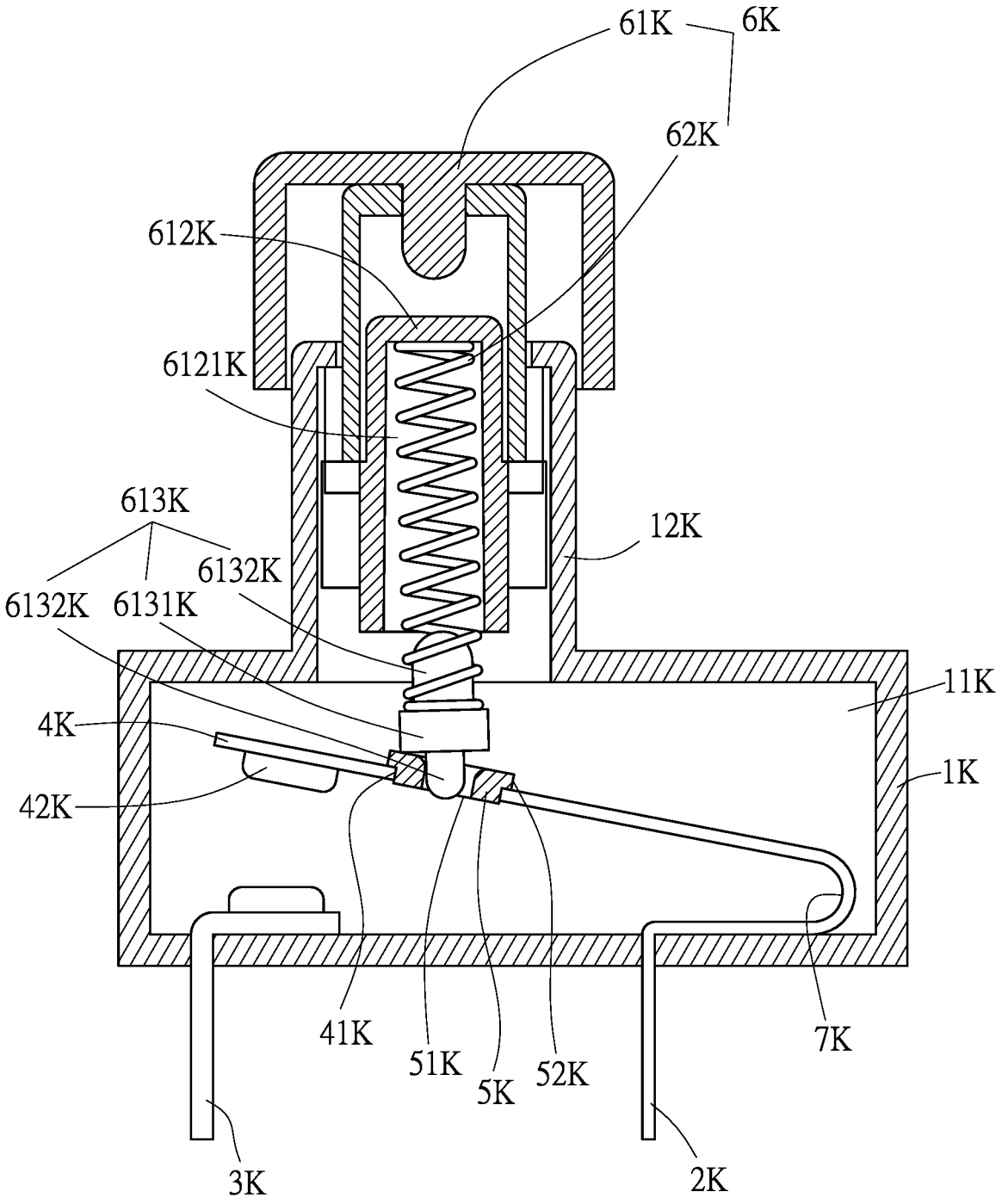
FIG. 31 is a schematic view of an eleventh embodiment of the present invention, and shows a press switch structure with the press switch in a closed position.

Referring to FIG. 31, which shows an eleventh embodiment of the present invention, wherein the heat destructive disconnecting switch of the present embodiment is a press switch, and FIG. 31 depicts the press switch in a closed state. The press switch comprises:

A base (1K), which is provided with a holding space (11K) and a protruding portion (12K); a first conductive member (2K) and a second conductive member (3K), both of which penetrate and are mounted on the base (1K); a movable conductive member, which is mounted within the holding space (11K), wherein the movable conductive member is a conductive cantilever member (4K); and an overheating destructive member (5K), which is destructed under a fail temperature condition, the fail temperature lying between 100° C. to 250° C. The overheating destructive member (5K) is not used to maintain the continued supply of electric current, thus, insulating material such as plastic or non-insulating material made of a low-melting alloy or low-melting metals can be used. The aforementioned low-melting alloy can be an alloy of bismuth and any one of or a composition from a plurality of cadmium, indium, silver, tin, lead, antimony, or copper; an example of which is a tin-bismuth alloy with a melting point around 138° C. In the present embodiment, the conductive cantilever member (4K) is provided with a mounting hole (41K). The overheating destructive member (5K) assumes an annular shape and is provided with a through hole (51K). In addition, a rib (52K) extends from the peripheral edge of the overheating destructive member (5K). The overheating destructive member (5K) is mounted in the mounting hole (41K), thereby restraining the rib (52K) on the peripheral edge of the mounting hole (41K).

If a circuit becomes overheated, it is preferred that a live wire triggers a circuit break. Therefore, the first conductive member (2K) in use is a live wire first end, the second conductive member (3K) in use is a live wire second end, and the conductive cantilever member (4K) is used to conduct current to the first conductive member (2K) and the second conductive member (3K) to form a live wire closed circuit.

The press switch of the present embodiment is further provided with an operating component (6K), which is used to operate the conductive cantilever member (4K) to connect with the first conductive member (2K) and the second conductive member (3K) to form a live wire closed circuit or disconnect the circuit between the first conductive member (2K) and the second conductive member (3K), causing the live wire to form an open circuit. The operating component (6K) is assembled on the base (1K) and comprises an operating member (61K) and a first elastic member (62K), wherein a press surface of the operating member (61K) is a nonconductor. The operating member (61K) is mounted on the protruding portion (12K) and has limited up and down displacement thereon. The up and down displacement and positioning structure of the entire operating component (6K) is the same as the press button structure of an automatic ball-point pen of the prior art, such as the prior art structure of a "Push-button Switch" disclosed in China Patent No. CN103441019; therefore, the drawings of the present embodiment omit illustrating a number of structural positions disclosed in the prior art. The operating member (61K) further comprises a limiting member (612K) and a contact member (613K), wherein the limiting member (612K) is provided with a hollow retaining space (6121K). The contact member (613K) is provided with a supporting base (6131K) and two limiting posts (6132K), which are located on corresponding surfaces of the supporting base (6131K), wherein one of the limiting posts (6132K) extends into the through hole (51K) of the overheating destructive member (5K). The first elastic member (62K) is inserted within the retaining space (6121K), and the other limiting post (6132K) of the contact member (613K) extends into the first elastic member (62K). The first elastic member (62K) is compressed and confined between the overheating destructive member (5K) and the limiting member (612K), which provides the first elastic member (62K) with a first elastic force.

The press switch of the present embodiment is further provided with a second elastic member, which is a spring plate (7K). The first conductive member (2K), the spring plate (7K), and the conductive cantilever member (4K) are formed as an integral body. The spring plate (7K) is provided with a second elastic force that acts on the operating member (61K).

Figure 32:
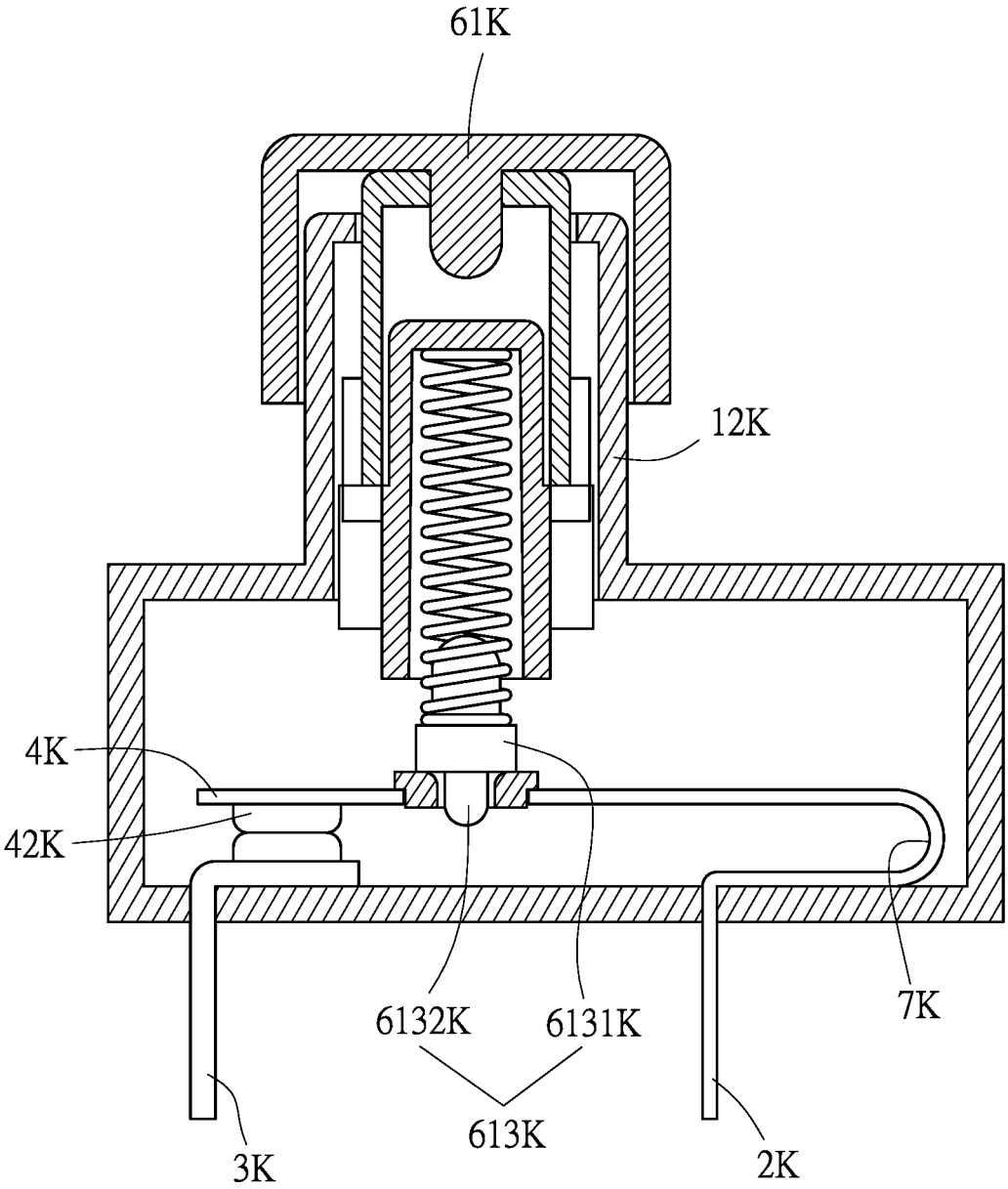
FIG. 32 is a schematic view of the eleventh embodiment of the present invention, and shows the press switch in an open position.

Referring to FIG. 32, a user displaces the operating member (61K) relative to the protruding portion (12K), just like pressing the button on an automatic ball-point pen, which causes the conductive cantilever member (4K) to selectively contact or separate from the second conductive member (3K). When the operating member (61K) is displaced in the direction of the conductive cantilever member (4K) and positioned, the supporting base (6131K) of the contact member (613K) presses a silver contact point (42K) of the conductive cantilever member (4K), which causes the conductive cantilever member (4K) to contact the second conductive member (3K) and form a power-on state. At the same time, the first elastic member (62K) is further compressed, enlarging the first elastic force thereof, at which time the first elastic force is larger than the second elastic force.

Figure 33:
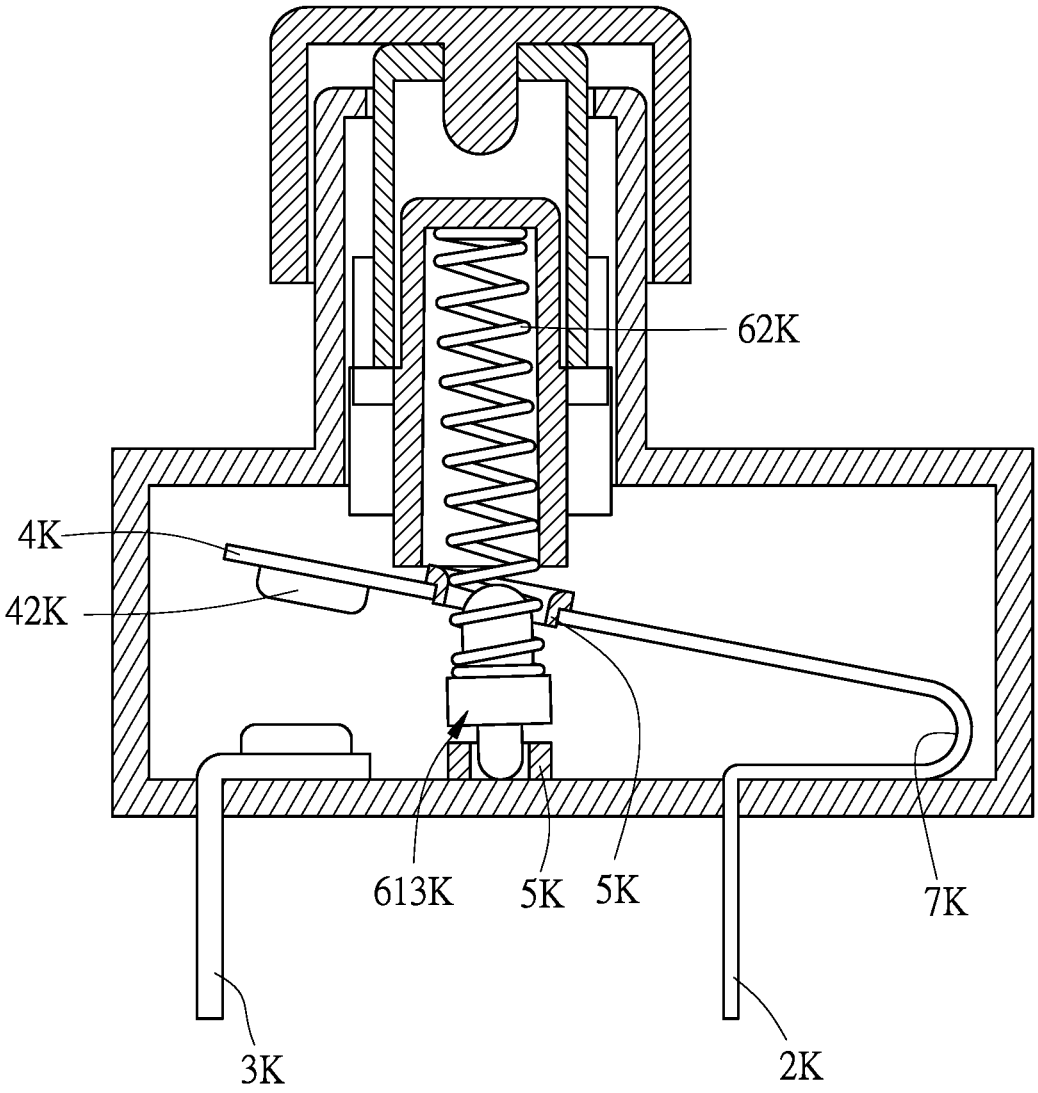
FIG. 33 is a schematic view of the eleventh embodiment of the present invention, and shows, when an overheating destructive member is destructed due to overheating, a movable conductive member separated from a second conductive member to form an open circuit.

Referring to FIG. 33, when an abnormal condition occurs in an external electric equipment connected to the first conductive member (2K) or the second conductive member (3K), for example, the external electric equipment is a plug socket, oxides or dust present between the metal pins of a plug and the plug socket, or phenomena such as incomplete insertion of the metal pins or distorted metal pins will produce relatively large amounts of heat energy in the electrical conducting portions of the plug socket, whereupon, the heat energy is transferred to the conductive cantilever member (4K) through the first conductive member (2K) or the second conductive member (3K), and then transferred to the overheating destructive member (5K) through the conductive cantilever member (4K). The overheating destructive member (5K) gradually absorbs the heat energy up to a point prior to the melting point thereof, at which time the overheating destructive member (5K) gradually loses its rigidity. For example, if the material of the overheating destructive member (5K) is a tin-bismuth alloy, although the melting point thereof is 138° C., the tin-bismuth alloy begins to lose its rigidity when the temperature is close to its melting point, and under the concurrent effect of the first elastic force, the first elastic member (62K) presses the contact member (613K), whereby the contact member (613K) presses the overheating destructive member (5K), causes the overheating destructive member (5K) becomes deformed under the pressure to the extent of being destructed and is no longer able to restrain the first elastic member (62K). In the present embodiment, the overheating destructive portion (5K) shown in FIG. 31, having been destructed into two portions, becomes the state shown in FIG. 33, which causes the first elastic member (62K) to elongate, resulting in lessening or loss of the first elastic force. At which time, the second elastic force is larger than the first elastic force, forcing the conductive cantilever member (4K) to restore its original position, causing the silver contact point (42K) of the conductive cantilever member (4K) to separate from the second conductive member (3K) and form a power-off state, thereby achieving the protective effect against overheating.

Figure 34:
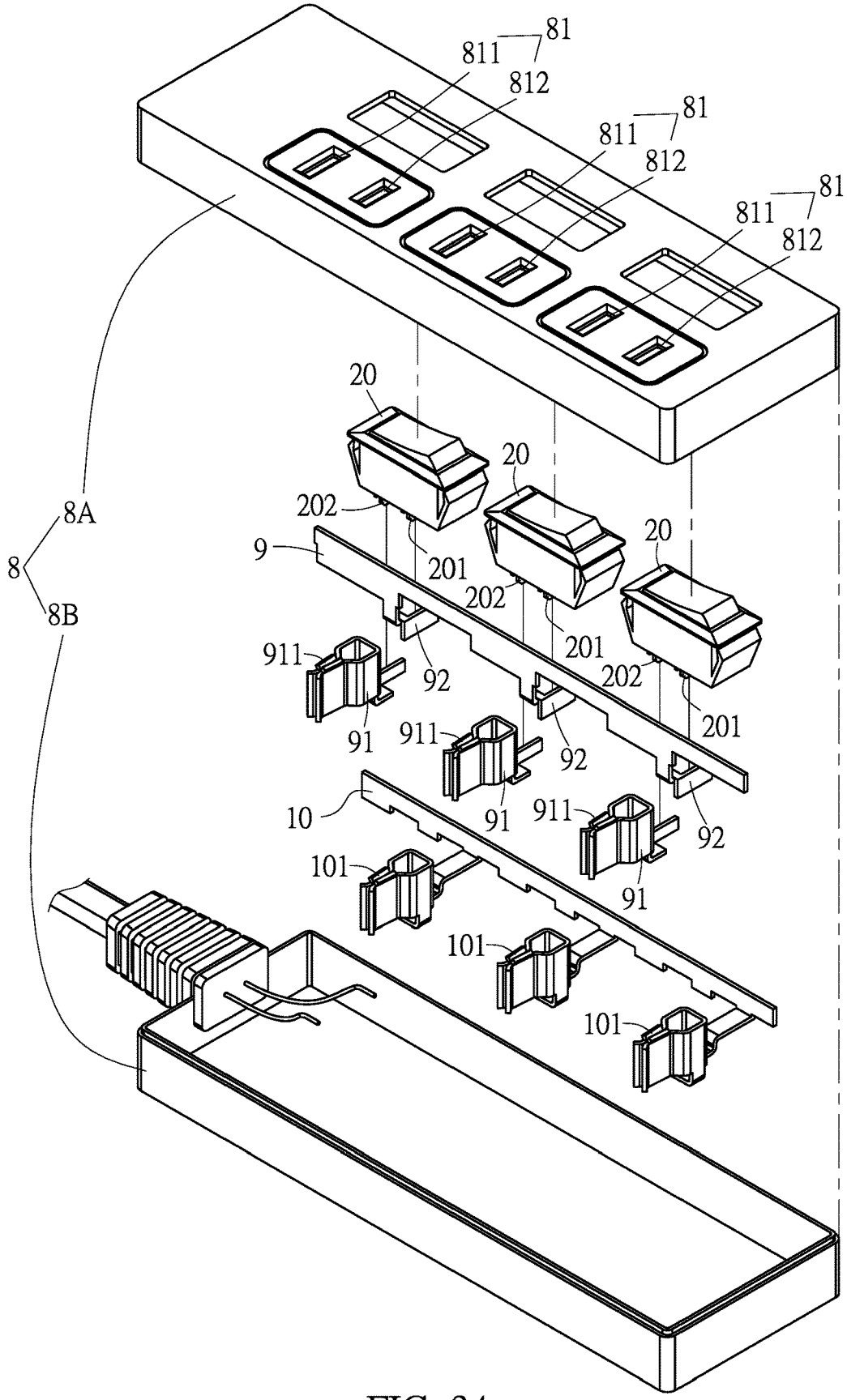
FIG. 34 is an exploded view of a heat destructive disconnecting switch of the present invention used in an extension cord socket.
Figure 35:
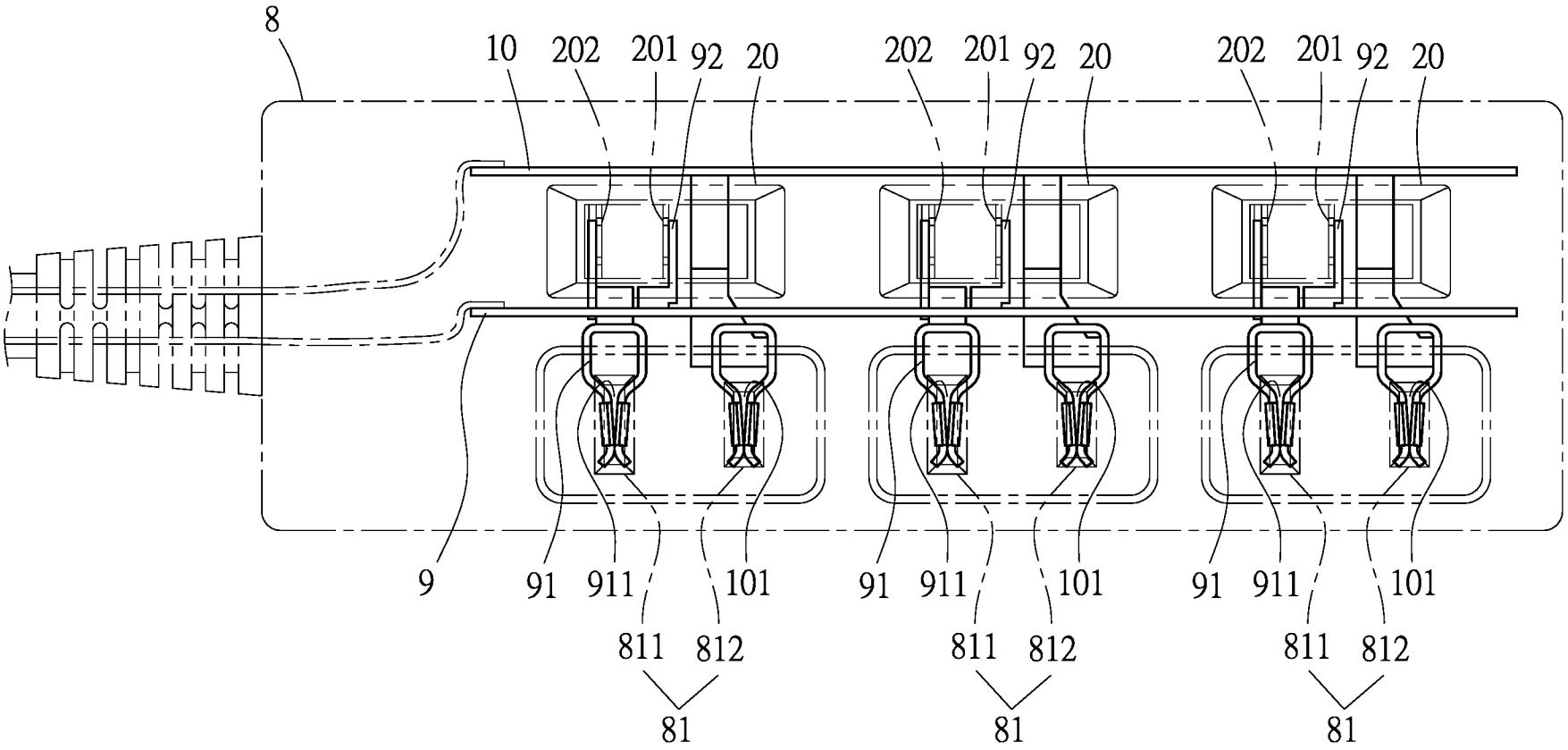
FIG. 35 is a structural view of the heat destructive disconnecting switch of the present invention used in an extension cord socket.

Referring to FIG. 34 and FIG. 35, which show another embodiment of the present invention, wherein the present embodiment applies the heat destructive disconnecting seesaw switch of the above-described embodiment in an extension cord socket, and is used to control the power-on state or power-off state of the electric equipment. As an example, the extension cord socket used in the present embodiment comprises three sets of socket apertures (81), and further comprises:

A casing (8), provided with an upper casing (8A) and a lower casing (8B), wherein the upper casing (8A) comprises the three socket apertures (81), and each of the socket apertures (81) comprises a live wire socket (811) and a neutral wire socket (812); a live wire conductive member (9), which is installed in the casing (8), wherein the live wire conductive member (9) is provided with three spaced live wire connecting ends (92); three live wire insert pieces (91), wherein each of the live wire insert pieces (91) comprises a live wire slot (911), and the live wire slots (911) correspond to the live wire sockets (811); a neutral wire conductive member (10), which is installed in the casing (8), wherein the neutral wire conductive member (10) is provided with three spaced neutral wire slots (101), and each of the neutral wire slots (101) corresponds to the respective neutral wire socket (812); and three heat destructive disconnecting switches (20), which are as described above in the first embodiment to the fourth embodiment. A first conductive member (201) of the heat destructive disconnecting switch (20) is connected to either the live wire connecting end (92) of the live wire conductive member (9) or the live wire insert piece (91), and the second conductive member (202) is connected to the live wire insert piece (91) or another of the live wire connecting ends (92) of the live wire conductive member (9). As an example, the first conductive member (201) is connected to the live wire connecting end (92) of the live wire conductive member (9) and the second conductive member (202) is connected to the live wire insert first (91) (the characteristics of the connecting method for this portion have already been detailed in the above-described embodiments, and thus not further detailed herein). Accordingly, when there is a temperature anomaly rise in the operating temperature in any one of the live wire insert pieces (91) of the extension cord socket, heat energy is transferred to the heat destructive disconnecting switch (20) associated therewith through the first conductive member (201) or the second conductive member (202), whereupon overheating causes the heat destructive disconnecting switch (20) to break the circuit, thereby cutting off the supply of power. At which time the live wire insert piece (91) with an abnormal temperature immediately cuts off the supply of power, thus stopping the operating temperature from continuing to rise and enabling the operating temperature to slowly fall. Because each of the heat destructive disconnecting switches (20) independently controls a set of the live wire socket (811) and neutral wire socket (812), thus, when any one of the heat destructive disconnecting switches (20) breaks the circuit due to overheating, the other sets of live wire sockets (811) and neutral wire sockets (812) can still continue to operate as normal.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An overheating destructive disconnecting method for switch, comprising the following steps:

enabling a first elastic force through an operating member under normal conditions to concurrently apply a force to an overheating destructive member and a movable conductive member, whereby a force application direction of the first elastic force enables the movable conductive member to concurrently contact a first conductive member and a second conductive member to form a conductive circuit;

enabling a second elastic force through the operating member to act on the movable conductive member, whereby a force application direction of the second elastic force enables the movable conductive member to separate from the first conductive member or the second conductive member;

enabling installation position of the overheating destructive member to only receive heat energy from a current-carrying circuit and not be used to allow current to flow to the current-carrying circuit;

when the overheating destructive member is destructed or deformed under a fail temperature condition, resulting in lessening or loss of the force applied by the first elastic force acting on the movable conductive member, then the second elastic force presses and forces the movable conductive member to change position, which causes the movable conductive member to no longer allow electrical conduction to the first conductive member and the second conductive member, thereby breaking the current-carrying circuit.

2. The overheating destructive disconnecting method for switch according to claim 1, wherein the fail temperature of the overheating destructive member lies between 100° C. to 250° C.

3. The overheating destructive disconnecting method for switch according to claim 2, wherein the overheating destructive member is made of plastic material.

4. The overheating destructive disconnecting method for switch according to claim 2, wherein the overheating destructive member is made of metal or an alloy.

5. The overheating destructive disconnecting method for switch according to claim 4, wherein the alloy is a tin-bismuth alloy, or additionally add one of or a combination of the metals cadmium, indium, silver, tin, lead, antimony, or copper to tin and bismuth.

* * * * *